US009176410B2

(12) United States Patent
Tani et al.

(10) Patent No.: US 9,176,410 B2
(45) Date of Patent: Nov. 3, 2015

(54) TONER

(71) Applicant: CANON KABUSHIKI KAISHA, Tokyo (JP)

(72) Inventors: Atsushi Tani, Suntou-gun (JP); Toshifumi Mori, Tokyo (JP); Takaaki Kaya, Suntou-gun (JP); Tetsuya Kinumatsu, Mishima (JP); Kenji Aoki, Mishima (JP); Shuntaro Watanabe, Hadano (JP); Yoshihiro Nakagawa, Numazu (JP); Takashige Kasuya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/361,276

(22) PCT Filed: Nov. 28, 2012

(86) PCT No.: PCT/JP2012/081432
§ 371 (c)(1),
(2) Date: May 28, 2014

(87) PCT Pub. No.: WO2013/081172
PCT Pub. Date: Jun. 6, 2013

(65) Prior Publication Data

US 2014/0356777 A1 Dec. 4, 2014

(30) Foreign Application Priority Data

Nov. 29, 2011 (JP) ..... 2011-260887

(51) Int. Cl.
*G03G 9/087* (2006.01)
*G03G 9/093* (2006.01)

(52) U.S. Cl.
CPC ..... *G03G 9/09321* (2013.01); *G03G 9/09328* (2013.01); *G03G 9/09357* (2013.01); *G03G 9/09392* (2013.01)

(58) Field of Classification Search
CPC ..... G03G 9/08791; G03G 9/09321; G03G 9/09328; G03G 9/09357; G03G 9/09392
See application file for complete search history.

(56) References Cited

U.S. PATENT DOCUMENTS 5,620,825 A * 4/1997 Tavernier et al. ..... 430/108.3

FOREIGN PATENT DOCUMENTS

| | | | |
|---|---|---|---|
| JP | 9-211896 | A | 8/1997 |
| JP | 2001-296695 | A | 10/2001 |
| JP | 2003-098727 | A | 4/2003 |
| JP | 2006-091283 | A | 4/2006 |

(Continued)

*Primary Examiner* — Peter Vajda
(74) *Attorney, Agent, or Firm* — Canon U.S.A. Inc., IP Division

(57) ABSTRACT

A toner having good low-temperature fixability, charge stability, environmental stability, and durability and capable of stably producing high-quality images for a long time is provided. The toner includes a toner particle having a core-shell structure constituted of a core and a shell phase. The core contains a binder resin, a colorant, and wax, and the shell phase contains a resin A. The resin A is a comb polymer including a main chain portion (X), a side chain portion (Y), and a side chain portion (Z). The main chain portion (X) is a vinyl polymer, the side chain portion (Y) has an aliphatic polyester structure and has an ester group concentration of a polyester segment of 6.5 mmol/g or less, and the side chain portion (Z) has an organic polysiloxane structure and has an average number of Si—O bond repeating units of a siloxane segment of 2 or more and 100 or less.

11 Claims, 2 Drawing Sheets

(56) References Cited

FOREIGN PATENT DOCUMENTS

| | | | |
|---|---|---|---|
| JP | 2009-168915 | A | 7/2009 |
| JP | 2010-168529 | A | 8/2010 |
| JP | 2011-094135 | A | 5/2011 |
| JP | 2011-127102 | A | 6/2011 |
| WO | 2012/165639 | A1 | 12/2012 |

* cited by examiner

TONER

TECHNICAL FIELD

The present invention generally relates to toners used in electrophotography, electrostatic recording, and toner jet recording. In particular, it relates to a toner used in image-forming apparatuses, such as copy machines, printers, and fax machines, in which a toner image formed on an electrostatic latent image bearing member is transferred onto a transfer material and fixed under heat and pressure to obtain a fixed image.

BACKGROUND ART

In recent years, energy conservation has been regarded as a significant technical objective for copy machines, printers, and fax machines and significant reduction of the amount of heat used in fixing units has been desired. Under such trends, there is a growing demand for low fixing temperature toners that can be fixed with low energy.

With a growing demand for these apparatuses worldwide, there has also been an increasing demand for apparatuses that can stably produce high-quality images in various operating environments, in particular, environments of various different temperature and humidity. Under such trends, the toners used in such apparatuses are desired to exhibit charge properties unaffected by the temperature and humidity and have high durability that causes less image deterioration even after a large number of copies and printouts are made.

An example of a typical method for improving the low temperature fixability of toners is to decrease the glass transition temperature (Tg) of binder resins in the toners. However, merely decreasing the Tg of binder resins impairs the thermal storage resistance of the toner. It has been considered difficult to achieve both the low temperature fixability and the thermal storage resistance.

In order to achieve the low temperature fixability and the thermal storage resistance at the same time, feasibility of using a crystalline resin that has a highly sharp melting characteristic as the binder resin has been investigated.

Amorphous resins generally used as binder resins in toners do not have endothermic peaks in differential scanning calorimetry (DSC) measurement. Binder resins that contain crystalline resins exhibit endothermic peaks in DSC measurement. The peak temperature of the endothermic peak is the melting point of the crystalline resin.

Crystalline polyester resins have a structure in which polymer chains are regularly aligned, do not readily soften in the temperature region below the melting point, and have a property of rapidly melting and undergoing a decrease in viscosity at and after the melting point. Because of these properties, crystalline polyester resins have drawn much attention in recent years and studies have been actively made on use of crystalline polyester resins as a material of toners.

PTL 1 proposes a toner obtained by dispersing in a liquid or supercritical carbon dioxide a solution of a resin constituted by an amorphous segment and a crystalline segment containing an aliphatic polyester (i.e., crystalline polyester) as an essential component in an organic solvent so as to form resin particles containing the resin and the organic solvent, and then removing the organic solvent and carbon dioxide.

PTL 2 proposes a toner obtained by dispersing in a liquid or supercritical carbon dioxide fine particles containing a resin that contains a vinyl monomer having a crystalline polyester chain as an essential constitutional unit to prepare a dispersion, and dispersing in this dispersion a solution of a resin that will serve as a binder resin in an organic solvent so as to form resin particles having the fine particles fixed to the surfaces, and then removing the organic solvent and carbon dioxide.

Compared to typical toners that use amorphous resins as binder resins, these toners exhibit superior low temperature fixability due to the sharp melting characteristic of the crystalline polyester. However, studies conducted by the inventors of the present application have shown that these toners do not necessarily have sufficient charge properties and have a tendency of not stably retaining the amount of charge after triboelectric charging. When a developer that contains such a toner is left unstirred, scattering of the toner to non-image portions and image defects readily occur in the subsequent development step and high-quality images are not always obtained.

The cause thereof is presumably that crystalline polyesters have a volume resistivity lower than typical amorphous resins and leakage of charge readily occur when the crystalline polyester contained in the toner is exposed in particle surfaces.

Another possible approach for improving the environmental stability of the toner is to cover the toner particle surfaces with a hydrophobic material. Organic polysiloxanes are known to have a low surface tension. Thus, introducing an organic polysiloxane structure into surface portions of toner particles may produce a toner that has a charge property unaffected by the ambient humidity.

PTL 3 proposes a toner obtained by dispersing an organic solvent solution of a resin containing a crystalline polyester into liquid or supercritical carbon dioxide containing dispersed fine particles containing a resin that contains a vinyl monomer (silicone-containing vinyl monomer) having an organic polysiloxane structure as an essential constitutional unit so as to form resin particles having the fine particles fixed to the surfaces, and then removing the organic solvent and carbon dioxide.

The toner obtained in accordance with this disclosure was evaluated in terms of the fixability. It was found that compared to other toners having similar melt viscosity characteristics, this toner had a tendency to readily separate on rubbing of the surface of the fixed image.

The cause for this is presumably that the ratio of the vinyl monomer having the organic polysiloxane structure contained in the resin is excessively large and this made the toner susceptible to the influence of surface tension and decreased the adhesion between the fused toner and paper.

This toner was also evaluated in terms of durability. It was found that the toner had a tendency to cause development banding as the evaluation cycle was repeated.

The cause for this is presumably that since an organic polysiloxane usually has a glass transition temperature (Tg) lower than room temperature, the degree of polymerization (molecular weight) of the siloxane segment in the vinyl monomer became excessively high, and that since the ratio of the vinyl monomer having the organic polysiloxane structure contained in the resin was excessively large, the hardness of the toner surface became insufficient and fusing onto a regulation member occurred.

As discussed above, toners that contain crystalline polyesters have to be improved to achieve sufficient low temperature fixability and stable charge property. Moreover, in order to improve the environmental stability by introduction of organic polysiloxane structures, the stability and durability of the fixed images have to be improved.

It is desirable to provide a toner that address the issues described above. It is desirable to provide a toner that has good low-temperature fixability, charge stability, environmental stability, and durability, and is capable of stably producing high-quality images for a long time.

CITATION LIST

Patent Literature

PTL 1 Japanese Patent Laid-Open No. 2010-168529
PTL 2 Japanese Patent Laid-Open No. 2011-127102
PTL 3 Japanese Patent Laid-Open No. 2011-094135

Summary of Invention

An aspect of the invention provides a toner that includes toner particles. Each of the toner particles has a core-shell structure constituted of a core and a shell phase. The core contains a binder resin, a colorant, and a wax, and the shell phase contains a resin A. The resin A is a comb polymer having a main chain portion (X), a side chain portion (Y), and a side chain portion (Z). The main chain portion (X) is a vinyl polymer. The side chain portion (Y) has an aliphatic polyester structure and has an ester group concentration of a polyester segment of 6.5 mmol/g or less. The side chain portion (Z) has an organic polysiloxane structure in which an average number of Si—O bond repeating units of a siloxane segment is 2 or more and 100 or less.

A toner having good low-temperature fixability, charge stability, environmental stability, and durability and capable of stably producing high-quality images for a long time can be provided.

Further features of the present invention will become apparent from the following description of exemplary embodiments with reference to the attached drawings.

DESCRIPTION OF EMBODIMENTS

Figure 1:
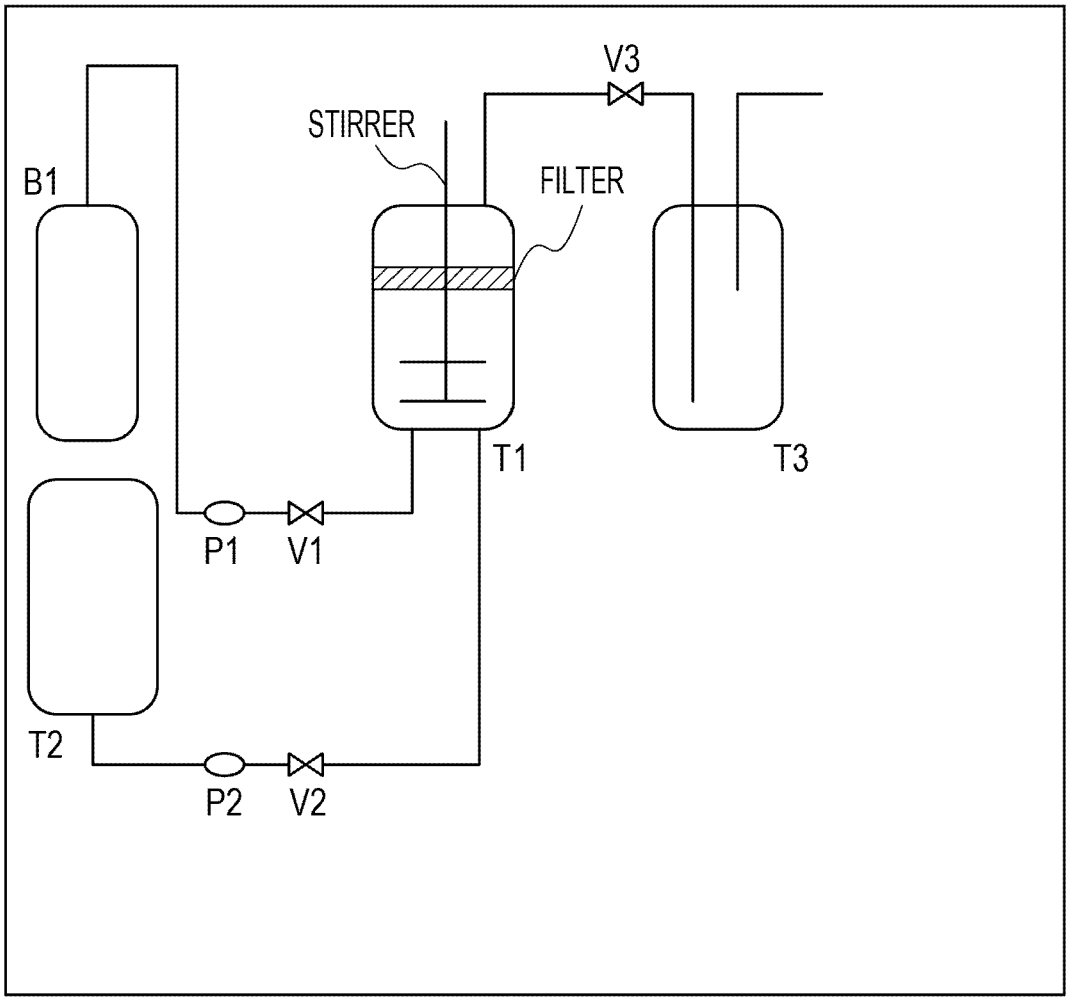
FIG. 1 is schematic view illustrating an example of an apparatus for manufacturing a toner.

A toner according to an embodiment of the present invention includes toner particles each having a core shell structure constituted by a core containing a binder resin, a colorant, and a wax and a shell phase containing a resin A on the surface of the core. The feature of the toner is that the resin A is a comb polymer that includes a main chain portion (X), a side chain portion (Y), and another side chain portion (Z).

The main chain portion (X) which serves as the main skeleton of the comb polymer used as the resin A constituting the shell phase contains a vinyl polymer.

Examples of the resin A include comb polymers described in items i) and ii) below:

i) Comb polymer obtained by copolymerization of a vinyl monomer (y) having a side chain portion (Y), a vinyl monomer (z) having a side chain portion (Z), and, optionally, another vinyl monomer; and ii) Comb polymer obtained as in item i) except that a vinyl monomer that serves as a precursor for introducing a side chain portion is used instead of the vinyl monomer (y) or the vinyl monomer (z) and then the side chain portion (Y) or the side chain portion (Z) is introduced.

The side chain portion (Y) in the comb polymer contained in the toner will now be described.

The side chain portion (Y) includes a segment having an aliphatic polyester structure. An aliphatic polyester structure is a structure in which aliphatic hydrocarbon groups are bonded to each other through ester bonds.

When a large number of the segments having such a structure gather, they align regularly and crystallinity is exhibited. Accordingly, a comb polymer having a highly sharp melting characteristic is obtained when a segment having an aliphatic polyester structure (hereinafter also referred to as an aliphatic polyester segment or a polyester segment) is included in the side chain portion (Y).

The aliphatic hydrocarbon groups can include branched structures but may be straight-chain aliphatic hydrocarbon groups from the viewpoint of increasing the crystallinity of the comb polymer.

The aliphatic polyester segment can be obtained by an esterification reaction between an aliphatic diol and an aliphatic dicarboxylic acid.

Examples of the aliphatic diols include straight-chain aliphatic diols having 4 or more and 20 or less carbon atoms. Specific examples include 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. These may be used alone or in combination.

Examples of the aliphatic dicarboxylic acid include straight-chain aliphatic dicarboxylic acids having 4 or more and 20 or less carbon atoms. Specific examples thereof include adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, and 1,18-octadecane dicarboxylic acid, and lower alkyl esters and anhydrides thereof. These may be used alone or in combination.

The aliphatic polyester segment can have a weight-average molecular weight (Mw) of 2,000 or more and 40,000 or less in gel permeation chromatography (GPC) of tetrahydrofuran (THF) soluble matter. When Mw is within this range, the crystallinity of the aliphatic polyester segment can be further enhanced, and a good sharp melting characteristic can be imparted to the comb polymer. A more preferable range of Mw is 3,000 or more and 20,000 or less.

The aliphatic polyester segment may have a maximum endothermic peak temperature of 60° C. or higher and 90° C. or lower in DSC measurement. When the peak temperature is within this range, the sharp melting effect of the comb polymer can be effectively exhibited and a toner that has good low temperature fixability can be obtained. A more preferable range of the peak temperature is 65° C. or higher and 85° C. or lower.

As discussed above, generally, crystalline polyesters (aliphatic polyesters in this disclosure) are known to have lower volume resistivity than typical amorphous resins. Accordingly, when such a crystalline polyester is used as a constitutional component of a shell phase, the toner obtained as a result will have low stability in terms of the amount of charge after triboelectric charging.

The inventors have focused on the influence of the difference in molecular structure of the aliphatic polyesters on the volume resistivity and synthesized various types of resins while changing the combination of the aliphatic diol and the aliphatic dicarboxylic acid. As a result of detailed investigations, they have found that there is a clear correlation between the number of ester bonds (ester group concentration) contained in a resin per unit mass and the volume resistivity. In other words, they have found that the aliphatic polyester resins tend to exhibit an increasing volume resistivity with a decrease in ester group concentration.

The inventors considers the following to be the reason for this tendency. As discussed earlier, when molecular chains of an aliphatic polyester gather, the molecular chains are regularly aligned. From the macroscopic perspective, the molecular chains retain a state in which molecular motion is limited in the temperature range below the melting point. However, usually, the glass transition point (Tg) of the aliphatic polyester is far lower than room temperature, and from the microscopic perspective, molecular motions can occur in a strained part of the molecular array in the crystal structure even at room temperature. Accordingly, exchange of charges between molecular chains through the ester bonds is possible, conduction paths are formed in portions where the ester bonds are found in high concentrations, and this presumably decreases the volume resistivity of the resin. In other words, decreasing the ester group concentration in the resin presumably suppresses formation of the conduction paths and then it becomes possible to increase the volume resistivity.

The type of the aliphatic diol and the aliphatic dicarboxylic acid determines the ester group concentration. In cases where the ester group concentration is to be low, an aliphatic diol and an aliphatic dicarboxylic acid containing a large number of carbon atoms may be selected. Fine adjustments may be made by controlling the molecular weight and/or the terminal groups of the resin.

Care should be taken in setting the ester group concentration to be low since the melting point (maximum endothermic peak temperature in DSC measurement) of the aliphatic polyester segment obtained will increase as a result.

The ester group concentration of the aliphatic polyester segment in the toner is 6.5 mmol/g or less on a polyester segment mass basis. Controlling the ester group concentration to 6.5 mmol/g or less can sufficiently increase the volume resistivity of the comb polymer.

The ester group concentration may be 5.0 mmol/g or more. When the ester group concentration is controlled to 5.0 mmol/g or more, the melting point of the comb polymer can be decreased to 90° C. or lower.

A toner that contains the comb polymer as the resin A suffers less from leakage of charge and exhibits high stability after triboelectric charging. Thus, a high-quality image free of toner scattering and image defects can be obtained. Since the sharp melting effect inherent to the aliphatic polyester is effectively exhibited, the toner also exhibits good low temperature fixability.

The method for synthesizing the aliphatic polyester segment may be any and a typical polyester resin polymerization method with which an alcohol component and an acid component are reacted with each other can be employed. Examples of the method include direct polycondensation and transesterification. The method can be appropriately selected in accordance with the type of diol and dicarboxylic acid used.

Synthesis of the aliphatic polyester segment may be performed at a polymerization temperature of 180° C. or higher and 230° C. or lower. If needed, the interior of the reaction system is vacuumed so that the reaction can be carried out while removing water and alcohols generated on condensation. In cases where a monomer is insoluble or incompatible with other materials at a reaction temperature, a solvent having a high boiling point can be added as a dissolving aid to dissolve the monomer. The polycondensation reaction is performed while distilling the dissolving aid away. In cases where there is a monomer poorly compatible with other materials in the copolymerization reaction, the poorly compatible monomer may be condensed with an acid or alcohol to be polycondensed with the monomer in advance, and then the resulting product may be polycondensed with a main component.

Synthesis of the aliphatic polyester segment can be catalyzed with a catalyst. Examples of the catalyst include titanium catalysts such as titanium tetraethoxide, titanium tetrapropoxide, titanium tetraisopropoxide, and titanium tetrabutoxide; and tin catalysts such as dibutyltin dichloride, dibutyltin oxide, and diphenyltin oxide.

Examples of the method for making a comb polymer having a side chain portion (Y) by using the aliphatic polyester segment described above are as follows:

(1) Method including preparing a vinyl monomer (y) having a side chain portion (Y) by performing an esterification reaction between the aliphatic polyester segment and a vinyl monomer having a hydroxyl group or a vinyl monomer having a carboxyl group, and then copolymerizing the vinyl monomer (y) with another vinyl monomer;

(2) Method including preparing a vinyl monomer (y) having a side chain portion (Y) by performing urethanation between a vinyl monomer having an isocyanate group and the aliphatic polyester segment and then copolymerizing the vinyl monomer (y) with another vinyl monomer;

(3) Method including preparing a vinyl monomer (y) having a side chain portion (Y) by urethanation of a vinyl monomer having a hydroxyl group and the aliphatic polyester group with a diisocyanate as a bonding agent, and then copolymerizing the vinyl monomer (y) with another vinyl monomer;

(4) Method including forming a main chain portion (X) by using a vinyl monomer having a hydroxyl group or a vinyl monomer having a carboxyl group and then esterifying the main chain portion (X) with the aliphatic polyester segment; and (5) Method including forming a main chain portion (X) by using a vinyl monomer having an isocyanate group and then conducting urethanation of the main chain portion (X) with the aliphatic polyester segment.

Of these methods, the methods (1) to (3) in which a vinyl monomer (y) having a side chain portion (Y) is prepared first and then copolymerized with another vinyl monomer are preferable and the methods (2) and (3) are more preferable in terms of the reactivity with the aliphatic polyester segment.

When the introduction of the aliphatic polyester segment is carried out through an esterification reaction with a carboxyl group or a urethanation reaction with an isocyanate group, the aliphatic polyester segment may be alcohol-terminated. Thus, the molar ratio of the diol to the dicarboxylic acid (diol/dicarboxylic acid) in the aliphatic polyester may be 1.02 or more and 1.20 or less. When the introduction of the aliphatic polyester segment is carried out through an esterification reaction with a hydroxyl group, the aliphatic polyester segment may be acid-terminated and the ratio of the diol to the dicarboxylic acid may be reversed.

Examples of the vinyl monomer having a hydroxyl group include hydroxylstyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol acrylate, polyethylene glycol monomethacrylate, allyl alcohol, methallyl alcohol, crotyl alcohol, isocrotyl alcohol, 1-buten-3-ol, 2-buten-1-ol, 2-butene-1,4-diol, propargyl alcohol, 2-hydroxyethyl propenyl ether, and sucrose allyl ether. Of these, hydroxyethyl methacrylate is particularly preferable.

The vinyl monomer having a carboxyl group may be an unsaturated monocarboxylic acid or unsaturated dicarboxylic acid having 30 or less carbon atoms, or an anhydride thereof.

Examples thereof include acrylic acid, methacrylic acid, maleic acid, fumaric acid, crotonic acid, itaconic acid, citraconic acid, itaconic acid, and cinnamic acid and anhydrides thereof. Among these, acrylic acid, methacrylic acid, maleic acid, and fumaric acid are particularly preferable.

Examples of the vinyl monomer having an isocyanate group include 2-isocyanatoethyl acrylate, 2-isocyanatoethyl methacrylate, methacrylic acid 2-(0-[1'-methylpropylideneamino]carboxyamino)ethyl, 2-[(3,5-dimethylpyrazolyl)carbonylamino]ethyl methacrylate, and m-isopropenyl-α,α-dimethylbenzyl isocyanate. Of these, 2-isocyanatoethyl acrylate and 2-isocyanatoethyl methacrylate are particularly preferable.

Examples of the diisocyanate include aliphatic diisocyanates, alicyclic diisocyanates, aromatic diisocyanates, and modified products of these diisocyanates (modified products containing a urethane group, a carbodiimide group, an allophanate group, a urea group, a biuret group, a uretdione group, a urethoimine group, an isocyanurate group, an oxazolidone group; hereinafter these may be referred to as modified diisocyanates).

The aliphatic diisocyanate may have 4 or more and 12 or less carbon atoms (excluding the carbon atoms in the isocyanate groups, the same applies hereinafter).

Examples of the aliphatic diisocyanate include ethylene diisocyanate, tetramethylene diisocyanate, hexamethylene diisocyanate (HDI), and dodecamethylene diisocyanate.

The alicyclic diisocyanate may have 4 or more and 15 or less carbon atoms. Specific examples thereof include isophorone diisocyanate (IPDI), dicyclohexylmethane-4,4'-diisocyanate, cyclohexylene diisocyanate, and methylcyclohexylene diisocyanate.

The aromatic diisocyanate may have 6 or more and 15 or less carbon atoms. Examples thereof include m- and/or p-xylylene diisocyanate (XDI) and α,α,α',α'-tetramethylxylylene diisocyanate. Among these, HDI, IPDI, and XDI are particularly preferable.

Another side chain portion (Z) in the comb polymer of the toner will now be described. The side chain portion (Z) contains a segment that has an organic polysiloxane structure. Here, an organic polysiloxane structure is a structure which has a repeating unit of a Si—O bond and in which two monovalent organic groups are bonded to each Si atom.

Examples of the organic group include an alkyl group, a cycloalkyl group, an aryl group, and an aralkyl group. These organic groups may contain a substituent. The organic groups may be the same as or different from each other. Among these organic groups, an alkyl group and an aryl group are preferable since the advantages of the organic polysiloxane described below can be fully exhibited. An alkyl group having 1 or more and 3 or less carbon atoms is more preferable and a methyl group is particularly preferable.

As described above, an organic polysiloxane has a low surface tension. Accordingly, appropriate hydrophobicity can be imparted to the comb polymer when a segment having an organic polysiloxane structure is contained in the side chain portion (Z).

The organic polysiloxane has a glass transition temperature (Tg) lower than room temperature and is a substance that is liquid and viscous at room temperature. Accordingly, when a segment having an organic polysiloxane structure is introduced as the side chain portion (Z), the resulting comb polymer tends to soften.

The average number of Si—O bond repeating units in the segment having an organic polysiloxane structure (hereinafter this segment may be simply referred to as an organic polysiloxane segment or a siloxane segment) in the toner is 2 or more and 100 or less. The average number of repeating units is an average value of the number of times the Si—O bonds of the siloxane chains contained in a plurality of side chain portions (Z) of the comb polymer are repeated.

When the average number of repeating units is less than 2, the siloxane does not exhibit its inherent properties and sufficient hydrophobicity is not imparted to the comb polymer. When the average number of repeating units is more than 100, the resulting polymer does not sufficiently cure and the comb polymer cannot retain sufficient hardness.

In other words, controlling the average number of Si—O bond repeating units of the organic polysiloxane segment to be within the above described range helps obtain a comb polymer that has a sufficient hardness as a toner resin and hydrophobicity that makes the polymer comply with changes in ambient humidity. The average number of repeating units is more preferably in the range of 2 or more and 15 or less.

When this comb polymer is used as the resin A, a toner that has sufficient durability against contamination of components caused by toner fusing and has charge properties less susceptible to environment with various temperature and humidity can be obtained.

When a comb polymer into which a side chain portion (Z) having an organic siloxane portion is introduced is used, the decrease in affinity between the toner and paper may occur due to a low surface tension. If the affinity with the paper is low, the adhesion between the paper and the thermally fused toner during fixing is decreased and separation of the fixed images easily occurs.

The toner of this embodiment may readily undergo a decrease in viscosity during fusing because of the aliphatic polyester segment contained in another side branch portion (Y) in the comb polymer. Accordingly, the fused toner readily enters gaps between fibers of the paper and thus separation of the toner caused by a decrease in adhesion can be prevented.

It is important that the organic polysiloxane segment and the aliphatic polyester segment of the toner coexist in the same molecule. For example, it is difficult to avoid the influence of the decreased adhesion when a mixture of a polymer containing only the organic polysiloxane segment and a polymer containing only the aliphatic polyester segment is used as the resin A.

It is also important that the organic polysiloxane segment and the aliphatic polyester segment of the toner respectively constitute different side chain portions so that they are independent from each other. Thus, the properties of each segment can be preserved and effectively exhibited.

An example of the organic polysiloxane segment in the toner is represented by formula (1) below:

[Chem. 1]

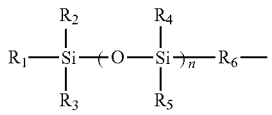

(1)

In the formula, $R_1$ to $R_5$ each independently represent a substituted or unsubstituted alkyl group having 1 or more and 3 or less carbon atoms or a substituted or unsubstituted aryl group. Preferably, $R_1$ to $R_5$ each represent a methyl group. $R_6$ is preferably an alkylene group having 1 or more and 10 or less carbon atoms. Furthermore, n represents a degree of polymerization and is an integer of 2 or more and 100 or less, and preferably 2 or more and 15 or less.

Examples of the method for making a comb polymer by introducing a side chain portion (Z) having an organic polysiloxane segment include the following:

(1) Method with which an organic polysiloxane having one terminus modified by, for example, a carbinol group, a carboxyl group, or an epoxy group is used as the side chain portion (Z) and is reacted with a resin that has a group reactive to this group; and (2) Method with which one terminus of an organic polysiloxane is modified with an acrylate or a methacrylate to prepare a vinyl monomer (z) having a side chain portion (Z) and the vinyl monomer (z) is copolymerized with another vinyl monomer.

Of these methods, the method in (2) is preferred for ease of synthesis. The vinyl monomer (z) preferably has a substructure represented by formula (a) and a substructure represented by formula (b) below. The vinyl monomer (z) is preferably a monomer represented by formula (2) below.

[Chem. 2]

(a)

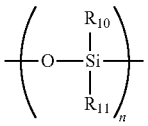

In formula (a), $R_{10}$ and $R_{11}$ each independently represent a substituted or unsubstituted alkyl group having 1 or more and 3 or less carbon atoms or a substituted or unsubstituted aryl group. $R_{10}$ and $R_{11}$ are each preferably a methyl group. In the formula, n represents a degree of polymerization and is an integer of 2 or more and 100 or less, and preferably 2 or more and 15 or less.

[Chem. 3]

(b)

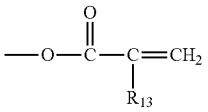

In formula (b), $R_{13}$ represents a hydrogen atom or a methyl group.

[Chem. 4]

(2)

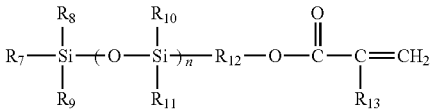

In formula (2), $R_7$ to $R_{11}$ each independently represent a substituted or unsubstituted alkyl group having 1 or more and 3 or less carbon atoms or a substituted or unsubstituted aryl group, and preferably a methyl group. $R_{12}$ is an alkylene group having 1 or more and 10 or less carbon atoms. $R_{13}$ represents a hydrogen atom or a methyl group. In the formula, n represents a degree of polymerization and is an integer of 2 or more and 100 or less, and preferably 2 or more and 15 or less.

The method for preparing the vinyl monomer (z) by modifying the organic polysiloxane with an acrylate or a methacrylate may be any. An example of the method is a method involving a dehydrochlorination between a carbinol-modified polysiloxane and acrylic acid chloride or methacrylic acid chloride.

The shell phase of the toner and the resin A contained in the shell phase will now be described in further detail.

The resin A may be a resin obtained by copolymerizing a vinyl monomer (y) having an aliphatic polyester structure and having an ester group concentration of 6.5 mmol/g or less and a vinyl monomer (z) having an organic polysiloxane structure represented by formula (2) above.

The ratio of the vinyl monomer (y) used in the synthesis of the resin A may be 15.0 mass % or more and 50.0 mass % or less relative to 100 mass % of all monomers used in the copolymerization. The ratio of the vinyl monomer (z) used may be 5.0 mass % or more and 25.0 mass % or less. The ratio of another vinyl monomer used may be 25.0 mass % or more and 80.0 mass % or less.

When the ratio of the vinyl monomer (y) is within the above described range, the effect of improving the low temperature fixability and the charge stability of the toner can be more effectively exhibited.

When the ratio of the vinyl monomer (z) is within the above described range, the effect of improving the environmental stability and durability of the toner can be more effectively exhibited.

When the vinyl monomer (y) and the vinyl monomer (z) are used at ratios within the above described ranges, the decrease in adhesion between the toner and the paper caused by the organic polysiloxane segment can be effectively suppressed and a more stable fixed image can be obtained. The ratio of the vinyl monomer (y) is more preferably 20.0 mass % or more and 45.0 mass % or less and the ratio of the vinyl monomer (z) is more preferably 10.0 mass % or more and 20.0 mass % or less.

Another vinyl monomer used in synthesis of the resin A may contain a vinyl monomer having a carboxyl group and/or a salt thereof.

Examples of the vinyl monomer having a carboxyl group include the same unsaturated monocarboxylic acid and unsaturated dicarboxylic acids having 30 or less carbon atoms, and anhydrides thereof as those described in preparing the vinyl monomer (y). Acrylic acid, methacrylic acid, maleic acid, and fumaric acid are particularly preferable. The type of the salt of the carboxylic group is preferably an alkali metal salt and more preferably a lithium salt, a sodium salt, or a potassium salt.

The amount of the vinyl monomer having a carboxyl group and/or salt thereof may be 1.0 mass % or more and 20.0 mass % or less relative to 100 mass % of all monomers used in the copolymerization. When the amount is within this range, a favorable charge property can be imparted to the toner. The amount is more preferably 3.0 mass % or more and 15.0 mass % or less.

A vinyl monomer having an aromatic ring may be further contained as the another vinyl monomer. Examples of the vinyl monomer having an aromatic ring include styrenes and hydrocarbyl (alkyl, cycloalkyl, aralkyl, alkenyl)-substituted styrenes, namely, α-methylstyrene, vinyl toluene, 2,4-dimethylstyrene, ethylstyrene, isopropylstyrene, butylstyrene, phenylstyrene, cyclohexylstyrene, benzylstyrene, and crotylbenzene; and divinylbenzene, divinyl toluene, divinylxylene, trivinylbenzene, and vinylnaphthalene. Among these, a styrene is particularly preferred. A styrene monomer not only has excellent copolymerizability but also an ability to further stabilize the charge property of the toner.

Vinyl monomers that are commonly used as the raw material for the vinyl resins described below may also be used. Examples thereof include, but are not limited to aliphatic vinyl hydrocarbons: alkenes (specifically, ethylene, propylene, butene, isobutylene, pentene, heptene, diisobutylene, octene, dodecene, and octadecene), α-olefines other than those described above; and alkadienes (specifically, butadiene, isoprene, 1,4-pentadiene, 1,6-hexadiene, and 1,7-octadiene);

alicyclic vinyl hydrocarbons: mono- or di-cycloalkenes and alkadienes (specifically, cyclohexene, cyclopentadiene, vinylcyclohexene, and ethylidenebicycloheptene), and terpenes (specifically, pinene, limonene, and indene); and vinyl esters: specifically, vinyl acetate, vinyl butyrate, vinyl propionate, diallyl phthalate, diallyl adipate, isopropenyl acetate, vinyl methacrylate, methyl 4-vinyl benzoate, cyclohexyl methacrylate, benzyl methacrylate, phenyl acrylate, phenyl methacrylate, vinyl methoxy acetate, vinyl benzoate, ethyl α-ethoxy acrylate, an alkyl acrylate or alkyl methacrylate having a straight or branched alkyl group having 1 or more and 11 or less carbon atoms (methyl acrylate, methyl methacrylate, ethyl acrylate, ethyl methacrylate, propyl acrylate, propyl methacrylate, butyl acrylate, butyl methacrylate, 2-ethyl hexyl acrylate, and 2-ethyl hexyl methacrylate), dialkyl fumarate (fumaric acid dialkyl ester) (where two alkyl groups are each a straight, branched, or alicyclic group having 2 or more and 8 or less carbon atoms), dialkyl maleate (maleic acid dialkyl ester) (where two alkyl groups are each a straight, branched, or alicyclic group having 2 or more and 8 or less carbon atoms), polyallyloxyalkanes (diallyloxyethane, triallyloxyethane, tetraallyloxypropane, tetraallyloxybutane, and tetramethallyloxyethane), a vinyl monomer having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol ethylene oxide (hereinafter ethylene oxide is referred to as EO) 10 mol adduct acrylate, methyl alcohol EO 10 mol adduct methacrylate, lauryl alcohol EO 30 mol adduct acrylate, and lauryl alcohol EO 30 mol adduct methacrylate), and polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylol propane trimethacrylate, polyethylene glycol diacrylate, and polyethylene glycol dimethacrylate).

The weight-average molecular weight (Mw) of the tetrahydrofuran (THF) soluble matter of the resin A measured by gel permeation chromatography (GPC) may be 15,000 or more and 100,000 or less. When Mw is within this range, the resin A exhibits an appropriate hardness and the toner exhibits improved durability. At Mw less than 15,000, the durability tends to be degraded. At Mw more than 100,000, the low temperature fixability may be degraded. A more preferable range of Mw is 20,000 or more and 80,000 or less.

Toner particles of the toner may contain 3.0 mass % or more and 15.0 mass % or less of the resin A. When the resin A content in the toner particles is within this range, the low-temperature fixability of the toner and the environmental stability can be notably improved.

The shell phase of the toner can contain a resin B in addition to the resin A. The resin B may be crystalline or amorphous or a crystalline resin and an amorphous resin may be used in combination. Non-limiting examples of the crystalline resin include crystalline polyesters and crystalline alkyl resins. Non-limiting examples of the amorphous resin include vinyl resins such as polyurethane resins, polyester resins, acrylic styrene resins, and polystyrenes. These resins may be modified with urethane, urea, or epoxy.

The ratio of the resin A in the resin constituting the shell phase is preferably 50.0 mass % or more and more preferably 100 mass %. When the amount of the resin A is less than 50.0 mass %, the effects of low-temperature fixability and the environmental stability may not be sufficiently exhibited.

The ratio of the shell phase with respect to the core is preferably 3.0 mass % or more and 30.0 mass % or less and more preferably 3.0 mass % or more and 20.0 mass % or less to improve the evenness of the coating on the core surface. Some of the surface of the core may be left uncoated with the shell phase and the core may be partially exposed. The shell phase need not be a layer having a clear interface with the core and the interface between the shell phase and the core may be unclear.

The binder resin contained in the toner will now be described. The binder resin may be crystalline or amorphous or may be a combination of a crystalline resin and an amorphous resin. The binder resin preferably contain a crystalline resin as a main component. The "main component" means that the ratio of the crystalline resin in the binder resin is 50 mass % or more.

As discussed above, a crystalline resin is a resin that has polymer molecular chains regularly aligned, barely softens below the melting temperature, and rapidly melts and softens at and above the melting temperature. Due to these properties, when a crystalline resin is used as the binder resin in the toner, a thermally fused toner readily enters the gaps between the fibers of the paper during fixing. Accordingly, not only the low-temperature fixability is improved as in the related art but also separation of the toner from the fixed image caused by the organic polysiloxane segment in the resin A in the shell phase can be suppressed.

Since the resin A contains the aliphatic polyester segment as described above, the crystalline resin may contain an aliphatic polyester of the same system from the viewpoint of adhesion to the shell phase.

The monomer used in preparing the aliphatic polyester may be the same combination of an aliphatic diol and an aliphatic dicarboxylic acid as that used in preparing the resin A.

An aliphatic diol having a double bond may also be used. Examples of the aliphatic diol having a double bond include 2-butene-1,4-diol, 3-hexene-1,6-diol, and 4-octene-1,8-diol.

A dicarboxylic acid having a double bond may also be used. Examples of the dicarboxylic acid include, but are not limited to, fumaric acid, maleic acid, 3-hexene dioic acid, and 3-octene dioic acid. Lower alkyl esters and anhydride of these may also be used. Among these, fumaric acid and maleic acid are preferred from the viewpoint of cost.

The melting point of the crystalline resin contained in the binder resin may be 50° C. or more and 80° C. or less. When the melting point of the crystalline resin is within this range, the toner exhibits low viscosity during fusing and readily enters the gaps between the fibers of the paper. If the melting point is lower than 50° C., the storage property of the toner may be degraded. If the melting point is higher than 80° C., the fusing viscosity of the toner is not readily decreased and the stability of the fixed image is likely to be degraded.

The melting point of the crystalline resin in the binder resin may be equal to or lower than the melting point of the resin A (derived from the aliphatic polyester segment) constituting the shell phase. In this manner, the binder resin having a low viscosity during fixing can more easily enter the gaps between the fibers of the paper and the stability of the fixed image can be further improved.

The crystalline resin may contain a copolymer in which a segment which is capable of forming a crystalline structure is chemically bonded to a segment which is incapable of forming a crystalline structure.

The meaning of the segment which is capable of forming a crystalline structure is that when a large number of such segments are gathered, the polymer chains align regularly to exhibit crystallinity. The meaning of the segment which is incapable of forming a crystalline structure is that when a large number of such segments are gathered, regular aligning does not occur but a random structure is created to form an amorphous segment.

Examples of the copolymer in which these segments are chemically bonded include block polymers, graft polymers, and star polymers. A block polymer is a copolymer in which polymer chains are covalently bonded to each other within a molecule. The binder resin more preferably contains a block polymer in which a segment which is capable of forming a crystalline structure and a segment which is incapable of forming a crystalline structure are bonded to each other.

Examples of the form of the block polymer include a crystalline (A) amorphous (B) (AB) diblock polymer, an ABA triblock polymer, a BAB triblock polymer, and an ABAB . . . multiblock polymer.

When such a block polymer is used in the crystalline resin as the binder resin, fine domains constituted by crystalline segments (A) can be evenly formed in the binder resin. As a result, the fusing viscosity of the binder resin can be effectively decreased during fixing, and the fused toner can more readily enter the gaps between the fibers of the paper.

The crystalline segments (A) may be composed of the aliphatic polyester described above. The amorphous segments (B) may be any amorphous portion and may be the same as the amorphous resin commonly used in the toner resin. However, the glass transition temperature (Tg) of the resin constituting the amorphous segments (B) is preferably 50° C. or more and 130° C. and more preferably 70° C. or more and 130° C. or less. When such amorphous segments (B) are contained, the elasticity of the toner in the fixed region after the sharp melting can be easily retained.

Specific examples of the resin constituting the amorphous segments (B) include polyurethane resins, amorphous polyester resins, styrene acrylic resins, polystyrenes, and styrene butadiene resins. These resins may be modified by urethane, urea, or epoxy. Among these, amorphous polyester resins and polyurethane resins are preferable from the viewpoint of retaining the elasticity.

Amorphous polyester resins used in the amorphous segments (B) will now be described. Examples of the monomers that can be used in preparing the amorphous polyester resin include known divalent or higher carboxylic acids and dihydric or higher alcohols such as those described in "Kobunshi Data Handbook: Basic" (edited by the Society of Polymer Science, published by Baifukan). Specific examples of these monomers are as follows.

Examples of the divalent carboxylic acids are diacids such as succinic acid, adipic acid, sebacic acid, phthalic acid, isophthalic acid, terephthalic acid, malonic acid, and dodecenylsuccinic acid, anhydrides thereof, and lower alkyl esters thereof; and aliphatic unsaturated dicarboxylic acids such as maleic acid, fumaric acid, itaconic acid, and citraconic acid.

Examples of the trivalent or higher carboxylic acids include 1,2,4-benzenetricarboxylic acid, 1,2,5-benzenetricarboxylic acid, anhydrides thereof, and lower alkyl esters thereof. These may be used alone or in combination.

Examples of the dihydric alcohol include bisphenol A, hydrogenated bisphenol A, an ethylene oxide or propylene oxide adduct of bisphenol A, 1,4-cyclohexanediol, 1,4-cyclohexanedimethanol, ethylene glycol, and propylene glycol.

Examples of the trihydric or higher alcohol include glycerin, trimethylol ethane, trimethylol propane, and pentaerythritol. These may be used alone or in combination.

A monovalent acid such as acetic acid or benzoic acid and a monohydric alcohol such as cyclohexanol or benzyl alcohol may also be used as needed to adjust the acid value and the hydroxyl value.

The amorphous polyester resin can be synthesized by, for example, methods described in "Jushukugo [Polycondensation]" (Kagakudojin Publishing), "Kobunshi Jikken Gaku [Polymer Experiment Studies]" (Jushukugo to Jufuka [Polycondensation and Polyaddition], published by Kyoritsu Shuppan Co., Ltd.), and "Polyester Jushi Handbook [Handbook of polyester resin]" (edited by Nikkan Kogyo Shimbun Ltd.). A transesterification method or a direct polycondensation method may be employed alone or in combination.

The polyurethane resin as the amorphous segments (B) will now be described. A polyurethane resin is a reaction product between a diol and a compound having a diisocyanate group.

Examples of the compound having a diisocyanate group include those described with reference to the preparation of the vinyl monomer (y) above. Examples thereof include aliphatic diisocyanates, alicyclic diisocyanates, aromatic diisocyanates, and modified products of these diisocyanates (diisocyanates modified by a urethane group, a carbodiimide group, an allophanate group, a urea group, a biuret group, a uretdione group, a uretimine group, an isocyanurate group, and an oxazolidine group, hereinafter also referred to as a modified diisocyanate). In particular, p-xylylene diisocyanate (XDI), isophorone diisocyanate (IPDI), and hexamethylene diisocyanate (HDI) are preferable.

In addition to the diisocyanate compound, a trifunctional or higher isocyanate compound can be used in the polyurethane resin.

Examples of the diol component that can be used in a polyurethane resin include alkylene glycol (ethylene glycol, 1,2-propylene glycol, and 1,3-propylene glycol); alkylene ether glycol (polyethylene glycol and polypropylene glycol); alicyclic diol (1,4-cyclohexanedimethanol); bisphenols (bisphenol A); and alkylene oxide (ethylene oxide and propylene oxide) adducts of the alicyclic diol.

The alkyl moiety of the alkylene glycol and alkylene ether glycol may be straight or branched. In this embodiment, an alkylene glycol having a branched structure may also be used.

In a block polymer containing a crystalline segment (A) and an amorphous segment (B) bonded to each other, the bonding may be achieved through ester bonding, urea bonding, or urethane bonding, for example. In particular, a block polymer that contains a urethane bond is preferable since it easily retains appropriate elasticity in a fixing temperature range after sharp melting and the high-temperature offset can be effectively suppressed.

The block polymer can be prepared by a two-step method with which a crystalline segment (A) and an amorphous segment (B) are first prepared separately and then bonded or a one-step method with which a monomer which is a source of a crystalline segment (A) and a monomer which is a source of an amorphous segment (B) are fed at the same time so that the synthesis is completed in one step.

The block polymer may be synthesized by a method selected from the various methods by considering the reactivity of the terminal functional groups of the polymers. In the description below, specific examples of preparing a block polymer by using a crystalline polyester as the crystalline segment (A) is described.

A block polymer containing a crystalline polyester and an amorphous polyester can be prepared by separately preparing the individual units and then bonding the units through a bonding agent. A bonding agent is not needed when the acid value of one of the polyesters is high and the hydroxyl value of the other polyester is high. In such a case, condensation reaction can be carried out by directly heating the polyesters under vacuum. The reaction temperature may be about 200° C.

In cases where a bonding agent is used, examples of the bonding agent are as follows: polyvalent carboxylic acids, polyhydric alcohols, polyvalent isocyanates, polyfunctional epoxy, and polyacid anhydrides. Synthesis can be carried out through a dehydration reaction or an addition reaction with these bonding agents.

A block polymer containing a crystalline polyester and a polyurethane can be prepared by separately preparing the individual units and then inducing an urethanation reaction between an alcohol terminus of the crystalline polyester and an isocyanate terminus of the polyurethane. Alternatively, synthesis is also possible by mixing an alcohol-terminated crystalline polyester and a diol and a diisocyanate constituting a polyurethane and heating the resulting mixture. In this case, a selective reaction between the diol and the diisocyanate occurs at the initial stage of reaction where the diol and diisocyanate concentrations are high to give a polyurethane, and a urethanation reaction between the isocyanate terminus of the polyurethane and the alcohol terminus of the crystalline polyester occurs after the molecular weight is increased to a particular level, thereby giving a block polymer.

The binder resin in the toner may contain 50 mass % or more and 85 mass % or less of a crystalline resin. When the crystalline resin is a block polymer, 50 mass % or more and 85 mass % or less of the crystalline resin may be contained as the crystalline segment (A) in the block polymer relative to the total amount of the binder resin. When the crystalline resin content in the binder resin is 50 mass % or more, the sharp melting property can be effectively exhibited. The crystalline resin content in the binder resin is more preferably 60 mass % or more and 80 mass % or less.

The binder resin may contain 15 mass % or more and 50 mass % or less of an amorphous resin. When the binder resin contains the block polymer, the total content of the amorphous segment (B) and the amorphous resin in the block polymer may be 15 mass % or more and 50 mass % or less relative to the total amount of the binder resin. When the amorphous resin content in the binder resin is 15 mass % or more, the elasticity can be satisfactorily retained after sharp melting. The amorphous resin content is more preferably 20 mass % or more and 40 mass % or less.

The amorphous resin may be the same as those used in the amorphous segment (B).

The binder resin in the toner may have a number-average molecular weight (Mn) of 8,000 or more and 30,000 or less and a weight-average molecular weight (Mw) of 15,000 or more and 60,000 or less in GPC measurement of THF soluble matter.

When the number-average molecular weight (Mn) and the weight-average molecular weight (Mw) are within these ranges, the toner exhibits an appropriate degree of viscoelasticity. Mn is more preferably in the range of 10,000 or more and 20,000 or less and Mw is more preferably in the range of 20,000 or more and 50,000 or less.

The ratio of Mw to Mn (Mw/Mn) may be 6 or less. At Mw/Mn of 6 or less, the crystallinity of the crystalline polyester in the binder resin increases appropriately and the endothermic peak observed in the DSC measurement becomes sharp. A more preferable range of Mw/Mn is 3 or less.

Other materials that can be used in the toner will now be described.

The toner particles contain a wax. Examples of the wax include aliphatic hydrocarbon wax such as low-molecular-weight polyethylene, low-molecular-weight polypropylene, low-molecular-weight olefin copolymers, microcrystalline wax, paraffin wax, and Fischer-Tropsch wax; oxides of aliphatic hydrocarbon wax such as polyethylene oxide wax; wax mainly composed of aliphatic acid esters such as aliphatic hydrocarbon ester wax; partly or wholly deoxidized aliphatic esters such as deoxidized carnauba wax; partially esterified products of a fatty acid and a polyhydric alcohol, such as behenic acid monoglyceride; and methyl ester compounds having hydroxyl groups obtained by hydrogenating vegetable oil and fat.

The wax used in this embodiment may be an aliphatic hydrocarbon wax or ester wax. Ester wax may be natural or synthetic as long as at least one ester bond is contained in a molecule.

Examples of the synthetic ester wax include monoester wax synthesized from saturated long straight chain aliphatic acids and saturated long straight chain aliphatic alcohols. The saturated long straight chain aliphatic acids are represented by general formula $C_nH_{2n+1}COOH$ where n may be or more and 28 or less. The saturated long straight chain aliphatic alcohols are represented by general formula $C_nH_{2n+1}OH$ where n may be 5 or more and 28 or less.

Examples of the natural ester wax include candelilla wax, carnauba wax, rice wax, and derivatives thereof.

Synthetic ester wax synthesized from a saturated long straight chain aliphatic acid and a saturated long straight chain aliphatic alcohol or natural wax that contains such an ester as the main component are more preferable.

The wax content in the toner according to this embodiment is preferably 2 mass % or more and 20 mass % or less and more preferably 2 mass % or more and 15 mass % or less. At a wax content less than 2 mass %, the releasability of the toner is rarely retained and thus sticking of paper easily occurs as the temperature of the fixed material decreases. At a wax content more than 20 mass %, the wax is likely to be exposed on the toner surface and the thermal storage resistance may be degraded. Moreover, problems such as fogging and fusion bonding may readily occur.

The wax used in this embodiment preferably has a maximum endothermic peak in the range of 60° C. or more and 120° C. or less and more preferably in the range of 60° C. or more and 90° C. or less in differential scanning calorimetry (DSC).

The toner particles contain a colorant. Examples of the colorant include organic pigments, organic dyes, inorganic pigments, and carbon black as black colorant, magnetic particles, and other colorants typically used in the toner.

Examples of yellow colorants include condensed azo compounds, isoindolinone compounds, anthraquinone compounds, azo metal complexes, methine compounds, and allylamide compounds. Specific examples thereof include C.I.

Pigment Yellow 12, 13, 14, 15, 17, 62, 74, 83, 93, 94, 95, 109, 110, 111, 128, 129, 147, 155, 168, and 180.

Examples of magenta colorants include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples thereof include C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Examples of cyan colorants include copper phthalocyanine compounds and derivatives thereof, anthraquinone compounds, and basic dye lake compounds. Specific examples thereof include C.I. Pigment Blue 1, 7, 15, 15:1, 15:2, 15:3, 15:4, 60, 62, and 66.

The colorants used in the toner are selected from the viewpoints of hue angle, saturation, brightness, lightfastness, OHP transparency, and dispersibility in the toner.

Relative to 100 parts by mass of the binder resin, 1 part by mass or more and 20 parts by mass or less of the colorant is used. When magnetic powder is used as the colorant, 40 parts by mass or more and 150 parts by mass or less of the magnetic particles may be used relative to 100 parts by mass of the binder resin.

The toner particles used in the toner of this embodiment may contain a charge controlling agent if needed. The charge controlling agent may be externally added to the toner particles. The charge controlling agent stabilizes the charge property and helps control the amount of triboelectric charge optimum for the development system.

A known charge controlling agent may be used. A charge controlling agent that has a high charging speed and a capacity to stably retain a particular amount of charge is preferred.

Examples of a charge controlling agent that effectively controls the toner to be negatively chargeable include organic metal compounds and chelating compounds, e.g., monoazo metal compounds, acetyl acetone metal compounds, aromatic oxycarboxylic acid, aromatic dicarboxylic acid, and metal compounds based on oxycarboxylic acid and dicarboxylic acid. Examples of a charge controlling agent that controls the toner to be positively chargeable include nigrosine, quaternary ammonium salts, metal salts of higher fatty acids, diorganotin borates, guanidine compounds, and imidazole compounds.

The amount of the charge controlling agent is preferably 0.01 parts by mass or more and 20 parts by mass or less and more preferably 0.5 parts by mass or more and 10 parts by mass or less relative to 100 parts by mass of the binder resin.

A method for making toner particles will now be described. First, a method for forming a core-shell structure featured in the toner of this embodiment is described.

The shell phase of the toner may be formed after forming the core. However, the core and the shell phase are preferably simultaneously made for the sake of simplicity. The method for forming the shell phase may be any.

An example of a method for forming a shell phase after formation of the core is a method that includes dispersing resin fine particles that form the core particles and the shell phase into an aqueous medium, causing the resin fine particles to aggregate on the surfaces of the core particles, and fixing the fine particles thereto.

An example of a method for simultaneously forming the core and the shell phase is a dissolution-and-suspension method. According to a dissolution-and-suspension method, a resin that forms the core is dissolved in an organic solvent to prepare a resin composition, the resin composition is dispersed in a dispersive medium to prepare a dispersion of liquid particles of the resin composition, and the organic solvent is removed from the dispersion of the liquid particles to obtain resin particles. During this method, resin fine particles that form the shell phase may be preliminarily dispersed in the dispersive medium so that the resin fine particles adhere to the surfaces of the liquid particles and form the shell phase.

A aqueous medium is typically used as the dispersive medium; however, a nonaqueous dispersive medium is preferably used in producing toner particles used in the toner of this embodiment. The resin fine particles constituting the shell phase of the toner of this embodiment contain the resin A described above. In the nonaqueous dispersive medium, the resin fine particles tend to orient toward the surfaces of the liquid particles due to the action of the organic polysiloxane segment in the resin A and the environmental stability is easily improved.

The nonaqueous dispersive medium is particularly preferably a medium that contains high-pressure carbon dioxide as a main component.

In sum, the toner particles may be prepared by dispersing a resin composition, which contains a binder resin, a colorant, and a wax dissolved or dispersed in an organic solvent, in a dispersive medium, which contains carbon dioxide as a main component and dispersed resin fine particles containing the resin A, and then removing the organic solvent from the resulting dispersion.

The high-pressure carbon dioxide used in this embodiment is carbon dioxide in a liquid state or in a supercritical state. Carbon dioxide in a liquid state refers to carbon dioxide at a temperature and a pressure within the range defined by a gas-liquid boundary passing the triple point (temperature: −57° C., pressure: 0.5 MPa) and the critical point (temperature: 31° C., pressure: 7.4 MPa), an isotherm of the critical temperature, and a solid-liquid boundary in a phase diagram of carbon dioxide. Carbon dioxide in a supercritical state refers to carbon dioxide at a temperature and a pressure equal to or higher than those of the critical point of carbon dioxide.

An example of a particularly preferable method for producing the toner particles will now be described in detail. According to this method, high-pressure carbon dioxide is used as the dispersive medium.

First, a binder resin, a colorant, a wax, and, if needed, other additives are homogeneously dissolved or dispersed in an organic solvent that can dissolve the binder resin by using a disperser such as a homogenizer, a ball mill, a colloid mill, or an ultrasonic disperser to prepare a resin composition.

Examples of the organic solvent that dissolves the binder resin include ketone solvents such as acetone, methyl ethyl ketone, methyl isobutyl ketone, and di-n-butyl ketone; ester solvents such as ethyl acetate, butyl acetate, and methoxybutyl acetate; ether solvents such as tetrahydrofuran, diethyl ether, dioxane, ethyl cellosolve, and butyl cellosolve; amide solvents such as dimethyl formamide and dimethyl acetamide; and aromatic hydrocarbon solvents such as toluene, xylene, and ethyl benzene.

The obtained resin composition is dispersed in carbon dioxide in a liquid state or in a supercritical state filling a container so as to prepare a dispersion of liquid particles of the resin composition.

This carbon dioxide in a liquid or supercritical state contains a dispersing agent dispersed therein in advance. Examples of the dispersing agent include organic or inorganic fine particles substances which may be used alone or in combination according to the purpose. In this embodiment, resin fine particles containing the resin A that forms the shell phase are used. During this process, an inorganic fine particle dispersing agent and another organic fine particle dispersing agent may be mixed.

Examples of the inorganic fine particle dispersing agent include inorganic fine particles of silica, alumina, zinc oxide, titania, and calcium oxide.

Examples of the organic fine particle dispersing agent include fine particles of the resin A, vinyl resins, urethane resins, epoxy resins, ester resins, polyamides, polyimides, silicone resins, fluorine resins, phenolic resins, melamine resins, benzoguanamine resins, urea resins, aniline resins, ionomer resins, polycarbonates, and cellulose, and mixtures thereof.

When resin fine particles are used as the dispersing agent and the resin fine particles are amorphous resin particles, carbon dioxide in a liquid or supercritical state dissolves in the resin and plasticizes the resin, thereby decreasing the glass transition temperature (Tg) of the resin. As a result, aggregation of the toner particles is accelerated. Accordingly, a resin having crystallinity may be used in the resin fine particles. If an amorphous resin is to be used, cross-linking structures may be introduced into the resin. The fine particles may be amorphous resin fine particles coated with a crystalline resin.

The dispersing agent may be used as is or may be surface-modified by performing various treatments so that the resin composition exhibits adsorbability to the surfaces of the liquid particles. Examples of the treatment include surface treatment with a silane-, titanate-, or aluminate-based coupling agent, surface treatment with various surfactants, and a coating treatment using a polymer.

The dispersing agent adsorbing to the surfaces of the liquid particles remain as are after formation of the toner particles. Thus, when the resin A or other resin fine particles are used as the dispersing agent, toner particles having surfaces coated with the shell phase constituted by the resin fine particles can be formed. The particle diameter of the resin fine particles is preferably 0.03 μm or more and 0.30 μm or less and more preferably 0.05 μm or more and 0.10 μm or less in terms of volume-average particle diameter (Dv). When the resin fine particles have excessively small diameters, the stability of the liquid particles during granulation tends to be low. When the resin fine particles are excessively large, it becomes difficult to control the diameter of the liquid particles to a desired level.

The amount of the resin fine particles may be 3.0 parts by mass or more and 20.0 parts by mass or less relative to the total solid content in the solution of the materials constituting the toner particles and can be appropriately adjusted in accordance with the stability of the liquid particles and the desired particle diameter.

In producing the toner particles, the dispersing agent may be dispersed in carbon dioxide in a liquid or supercritical state by any method. An example thereof is a method including feeding the dispersing agent and carbon dioxide in a liquid or supercritical state into a container and directly dispersing the dispersing agent in carbon dioxide by stirring or applying ultrasonic waves. Another example is a method including introducing a dispersion of the dispersing agent in an organic solvent into a container containing carbon dioxide in a liquid or supercritical state by using a high-pressure pump.

The resin composition may be dispersed in the dispersive medium containing carbon dioxide in a liquid or supercritical state through any method. An example thereof include a method including introducing the resin composition into a container containing a dispersed dispersing agent and carbon dioxide in a liquid or supercritical state by using a high-pressure pump. Alternatively, carbon dioxide in a liquid or supercritical state containing a dispersed dispersing agent may be introduced into a container containing the resin composition.

The dispersive medium containing carbon dioxide in a liquid or supercritical state may be of a single phase. In conducting granulation by dispersing the resin composition in carbon dioxide in a liquid or supercritical state, part of the organic solvent in the liquid particles migrates to the dispersion. During this process, it is not favorable to have a separate organic solvent phase in addition to the phase that contains carbon dioxide because this may impair the stability of the liquid particles. Accordingly, the temperature and pressure of the dispersive medium and the amount of the solution relative to carbon dioxide in a liquid or supercritical state may be controlled within a range that can form a homogeneous phase containing carbon dioxide and the organic solvent.

Regarding the temperature and pressure of the dispersive medium, the granulating property (ease of forming liquid particles) and the solubility of the constitutional components in the resin composition in the dispersive medium should also be considered. For example, the resin and wax in the resin composition may dissolve into the dispersive medium depending on the temperature conditions and the pressure condition. Usually, the solubility of these components in the dispersive medium is suppressed as the temperature and pressure decrease. However, the granulating property is degraded since the oil drops formed thereby tend to undergo aggregation and coalescence. The granulating property improves as the temperature and pressure increase but the components shows an increased tendency to dissolve in the dispersive medium.

In the case where a crystalline resin is contained in the binder resin, the temperature of the dispersive medium may be lower than the melting point of the crystalline resin so as not to impair the crystallinity. The temperature of the dispersive medium during production of the toner particles is preferably in a temperature range of 10° C. or more and 40° C. or less.

The pressure in the container for forming the dispersive medium is preferably 1 MPa or more and 20 MPa or less and more preferably 2 MPa or more and 15 MPa or less. In this description, the "pressure" means a total pressure in the cases where components other than carbon dioxide is contained in the dispersive medium.

The carbon dioxide ratio in the dispersive medium is usually 70 mass % or more, preferably 80 mass % or more, and more preferably 90 mass % or more.

After completion of granulation, the organic solvent remaining in the liquid particles are removed through the dispersive medium composed of carbon dioxide in a liquid or supercritical state. In particular, the dispersive medium containing dispersed liquid particles is further mixed with carbon dioxide in a liquid or supercritical state so as to extract the remaining organic solvent into the carbon dioxide phase, and carbon dioxide containing the organic solvent is substituted with additional carbon dioxide in a liquid or supercritical state.

Mixing of the dispersive medium and carbon dioxide in a liquid or supercritical state may be conducted by adding carbon dioxide in a liquid or super critical state to a dispersive medium having a lower pressure than the carbon dioxide or by adding the dispersive medium to carbon dioxide in a liquid or supercritical state having a lower pressure than the dispersive medium.

An example of the method for substituting carbon dioxide containing the organic solvent with additional carbon dioxide in a liquid or supercritical state is to distribute carbon dioxide in a liquid or supercritical state while maintaining the pressure in the container constant. During this process, the toner particles formed are captured by a filter.

When substitution with carbon dioxide in a liquid or supercritical state is insufficient and the organic solvent remains in the dispersive medium and when the container is vacuumed to recover the toner particles obtained, the organic solvent dissolved in the dispersive medium may become condensed and the toner particles may re-dissolve in the organic solvent or coalesce with one another, which is not favorable. Accordingly, the substitution with carbon dioxide in a liquid or supercritical state is to be conducted until the organic solvent is completely removed. The ratio of the volume of carbon dioxide in a liquid or supercritical state to be distributed relative to the volume of the dispersive medium is preferably 1 or more and 100 or less, more preferably 1 or more and 50 or less, and most preferably 1 or more and 30 or less.

During the process of vacuuming the container to recover toner particles from the dispersion containing dispersed toner particles and carbon dioxide in a liquid or supercritical state, the temperature and pressure may be decreased to normal levels in one step or may be decreased stepwise by providing multiple stages of containers independently pressure-controlled. The vacuuming rate may be set so as not to cause foaming of the toner particles.

When a crystalline resin is contained in the binder resin, the recovered toner particles may be heat-treated at a temperature lower than the melting point of the crystalline resin. In this description, this heat treatment is hereinafter referred to as an annealing treatment.

In general, a crystalline resin is known to exhibit a higher crystallinity by an annealing treatment. The principle behind this is presumably as follows. That is, when a crystalline material is annealed, the molecular mobility of the polymer chains increases to a particular level due to the heat. As a result, the polymer chains re-orient themselves to a more stable structure, i.e., a regular crystalline structure so as to cause crystallization. A heat treatment at a temperature higher than the melting point of the crystalline material gives the polymer chains energy higher than the energy needed for reorientation. Thus, the re-crystallization does not occur.

The annealing treatment is desirably performed in a limited temperature range with respect to the melting point of the crystalline resin in order to activate the molecular motion of the crystalline resin in the toner as much as possible. In particular, the endothermic peak temperature of the toner particles derived from the crystalline resin is determined by DSC at a heating rate of 10.0° C./min, and the annealing treatment is preferably performed in a temperature range of (peak temperature −15° C.) to (peak temperature −5° C.) inclusive and more preferably in a temperature range of (peak temperature −10° C.) to (peak temperature −5° C.) inclusive.

The annealing treatment time can be appropriately adjusted in accordance with the ratio of the crystalline resin in the toner, and the type and crystal state of the crystalline resin but is usually 1 hour or more and 50 hours or less. If the annealing time is less than 1 hour, the effect of recrystallization is rarely achieved. If the annealing time is more than 50 hours, the effect is no longer enhanced. A more preferable range of the annealing time is 2 hours to 24 hours inclusive. The annealing treatment may be conducted at any stage after formation of the toner particles.

The method of this embodiment can include a step of producing a toner by externally adding inorganic fine particles to the toner particles. The inorganic fine particles improve the fluidity of the toner and homogenize the charge of the toner.

Examples of the inorganic fine particles include silica fine powder, titanium oxide fine powder, alumina fine powder, and composite oxide fine powder of these. Among these, silica fine powder and titanium oxide fine powder are preferable.

Examples of the silica fine powder include dry silica or fumed silica generated by vapor phase oxidation of a silicon halide and wet silica produced from liquid glass. The inorganic fine powder may be dry silica containing fewer silanol groups on the surface and in the particles and less $Na_2O$ and $SO_3^{2-}$. Dry silica may be a composite fine powder of silica and other metal oxide produced by using a silicon halogen compound with a metal halogen compound such as aluminum chloride or titanium chloride in the production process.

The inorganic fine powder may be hydrophobized in order to adjust the amount of charge of the toner, improve the environmental stability, and improve the properties in a high-humidity environment. If the inorganic fine powder externally added to the toner absorb moisture, the amount of charge of the toner decreases and the developing property and transfer property are likely to be degraded.

Examples of a treating agent used in hydrophobing the inorganic fine powder include unmodified silicone varnish, various modified silicone varnish, unmodified silicone oil, various modified silicone oil, silane compounds, silane coupling agents, other organic silicon compounds, and organic titanium compounds. These treatment agents may be used alone or in combination.

Among these, inorganic fine powder treated with silicone oil is preferable. A more preferable is hydrophobized inorganic fine powder obtained by hydrophobing inorganic fine powder with a coupling agent and treating the inorganic fine powder with silicone oil simultaneously or in a subsequent step since such hydrophobized inorganic fine powder helps the toner to retain a high amount of charge in a high humidity environment and decreases the selective developing property.

The amount of the inorganic fine powder added is preferably 0.1 parts by mass or more and 4.0 parts by mass or less and more preferably 0.2 parts by mass or more and 3.5 parts by mass or less relative to 100 parts by mass of the toner particles.

The toner preferably has a weight-average particle diameter (D4) of 3.0 μm or more and 8.0 μm or less and more preferably 5.0 μm or more and 7.0 μm or less. When a toner having such a weight-average particle diameter (D4) is used, the toner is easy to handle and dot reproducibility is sufficiently satisfied.

The ratio (D4/D1) of the weight-average particle diameter (D4) to the number-average particle diameter (D1) of the toner is preferably 1.25 or less and more preferably 1.20 or less.

The methods for measuring various physical properties of the toner of this embodiment will now be described.

Method for Measuring Ester Group Concentration in Polyester Segment

The ester group concentration in the polyester segment used in the resin A that constitutes the shell phase is calculated as follows.

(1) Accurately weigh 0.1 to 0.3 g of a sample and assume the weight to be W (g).

(2) Add the sample to a 300 mL Erlenmeyer flask and add 25 mL of a 0.5 mol/l ethanol solution of potassium hydroxide.

(3) Attach an air cooler to the Erlenmeyer flask and carry out a reaction while occasionally shaking and gently heating the content for 30 minutes in a water bath or a sand bath or on a hot plate. Adjust heating temperature so that the backflow of ethanol does not reach the top of the air cooler.

(4) Immediately cool the content on completion of the reaction. Spray a small amount of water or a xylene/ethanol (1/3) mixed solution from the top of the air cooler before the content solidifies into a gel to clean the inner wall. Detach the air cooler.

(5) Titrate with 0.5 mol/l hydrochloric acid using a potentiometric titrator (e.g., automatic titration using a potentiometric titrator AT-400 (win workstation) and automatic piston burette ABP-410 produced by Kyoto Electronics Manufacturing Co., Ltd.).

(6) Assume the amount of hydrochloric acid used in (5) to be S (mL). Measure the blank and assume the amount of hydrochloric acid used in this process to be B (mL).

(7) Calculate the ester group concentration according to the following equation where f represents a hydrochloric acid factor:

Ester group concentration (mmol/g)={(B−S)×0.5 f}/W

Method for Measuring Degree n of Polymerization of Vinyl Monomer (z) Having Organic Polysiloxane Structure The degree n of polymerization of the vinyl monomer (z) having an organic polysiloxane structure used in the resin A constituting the shell phase is measured by $^1$H-NMR under the following conditions:

Measuring instrument: FT NMR instrument JNM-EX400 (produced by JEOL Ltd.)

Measurement frequency: 400 MHz

Pulse condition: 5.0 μs

Frequency range: 10500 Hz

Number of acquisitions: 64

Measurement temperature: 30° C.

Into a sample tube having an inner diameter of 5 mm, 50 mg of a sample (vinyl monomer (z)) is placed and deuterated chloroform ($CDCl_3$) is added thereto as a solvent. The sample is dissolved in a 40° C. thermostat to prepare a measurement sample. The measurement sample is measured under the above-described conditions and a 1H-NMR chart is obtained.

The integrated value $S_1$ of the peak (about 0.0 ppm) attributable to hydrogen bonded to carbon bonded to silicon is calculated from the obtained $^1$H-NMR chart. Similarly, the integrated value $S_2$ of the peak (about 6.0 ppm) attributable to one of terminal hydrogen atoms of a vinyl group is calculated.

The degree n of polymerization of the vinyl monomer (z) is calculated by rounding off the decimal places of the value calculated from the following equation by using the integrated values $S_1$ and $S_2$. In the equation, $n_1$ is a total number of hydrogen atoms bonded to carbon atoms bonded to one silicon atom.

Degree of polymerization of vinyl monomer (z) $n=\{(S_1-n_1)/n_1\}/S_2$

Method for Measuring Resin a Content in Toner Particles

The resin A content in the toner particles is calculated from the Si content determined by X-ray fluorescence analysis (XRF). A wavelength-dispersive XRF spectrometer, Axios advanced (produced by PANalytical) is used as a measuring instrument.

The elements from Na to U in the toner particles are directly measured in a He atmosphere by a fundamental parameter (FP) method. Assuming the total mass of all elements detected to be 100%, the Si content X (mass %) relative to the total mass is determined by UniQuant 5 software (ver. 5.49).

The same measurement is conducted on the resin A and the Si content Y (mass %) in the resin A is determined. The Resin A content is calculated by the following equation using the values of X and Y above:

$$\text{Resin } A \text{ content (mass \%)} = X/(Y/100)$$

Method for Measuring Coverage of the Toner Particle Surfaces with Resin a

The coverage of the toner particle surfaces with the resin A is calculated from the Si content derived from the organic polysiloxane segment determined by surface composition analysis by X-ray photoelectron spectroscopy (also known as electron spectroscopy for chemical analysis, ESCA). The instrument and the measurement conditions of ESCA are as follows:

Instrument used: Quantum 2000 produced by ULVAC-PHI, Inc.

Analysis method: narrow analysis

Measurement Conditions:

X-ray source: Al-Kα

X-ray condition: 100μ, 25 W, 15 kV

Photoelectron accepting angle: 45°

Pass energy: 58.70 eV

Measurement range: ϕ 100 μm

The toner particles were measured under the above-described conditions and the peak attributable to the C—C bond of the carbon is orbital is corrected to 285 eV. Then the Si content X (atomic %) derived from the organic polysiloxane structure relative to the total amount of the constitutional elements is calculated from the peak area of the peak of the Si—O bond of the silicon 2p orbital, which has a peak top detected at 100 eV or more and 103 eV or less, by using the relative sensitivity factor available from the ULVAC-PHI Inc. When other peaks of the Si2p orbital ($SiO_2$: larger than 103 eV but not larger than 105 eV) are detected, the waveform separation is conducted on the Si—O bond peak to calculate the peak area of the Si—O bond.

Next, the same measurement is conducted on the resin A to determine the Si content Y (atomic %). The coverage of the toner particle surfaces with the resin A is calculated from the equation below using the values of X and Y described above:

$$\text{Coverage with resin } A \text{ (\%)} = X/(Y/100)$$

Method for Measuring Peak Temperature (Tp) of Maximum Endothermic Peak

The peak temperatures (Tp) of the maximum endothermic peaks of the toner, the crystalline resin, the block polymer, and the aliphatic polyester segment are measured with a differential scanning calorimeter, DSC Q1000 (Produced by TA Instruments) under the following conditions:

Heating rate: 10° C./min

Measurement start temperature: 20° C.

Measurement end temperature: 180° C.

The temperature correction of the instrument detection unit is carried out by using the melting points of indium and zinc and the correction of heat quantity is carried out by using heat of fusion of indium.

To be more specific, about 5 mg of a sample is accurately weighed, placed in a pan, and measured once. An empty silver pan is used as the reference. The peak temperature of the maximum endothermic peak detected in this process is assumed to be Tp. Here, the maximum endothermic peak means a peak that has the highest endothermic energy amount among a plurality of peaks.

Method for Measuring Number-Average Molecular Weight (Mn) and Weight-Average Molecular Weight (Mw)

The number-average molecular weight (Mn) and the weight-average molecular weight (Mw) of the tetrahydrofuran (THF) soluble matter in the resin are measured as follows.

(1) Preparation of Measurement Sample

A resin (sample) and THF are mixed with each other so that the concentration is about 0.5 to 5 mg/mL (e.g., about 5 mg/mL) and the mixture is left to stand at room temperature for several hours (e.g., 5 to 6 hours). The mixture is thoroughly shaken until the sample is no longer coalesced. Then the mixture is left to stand still at room temperature for 12 hours or more (e.g., 24 hours). This process is controlled so that the time taken from the start of mixing the sample and THF to the end of leaving the mixture to stand still is 24 hours or more.

Then the sample is passed through a sample treating filter (pore size: 0.45 to 0.5 μm, MAISHORI Disk H-25-2 produced by Tosoh Corporation, EKIKURO Disk 25CR produced by German Science Japan may be used). The resulting sample is used as a GPC sample.

(2) Analysis of Sample

A column is stabilized in a 40° C. heat chamber, THF as a solvent is supplied at a flow rate of 1 mL/min into the column at this temperature. Measurement is conducted by injecting 50 to 200 μl of a THF sample solution of a resin having a sample concentration adjusted to 0.5 to 5 mg/mL.

In measuring the molecular weight of the sample, the molecular weight distribution of the sample is calculated from the relationship between the count number and logarithm of the calibration curves prepared by several types of monodispersed polystyrene standard samples.

The standard polystyrene samples used in preparing the calibration curves are those produced by Pressure Chemical Co., or Tosoh Corporation having molecular weights of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$. A refractive index (RI) detector is used as the detector.

In order to accurately measure the molecular weight region of $1\times10^3$ to $2\times10^6$, the following combination of commercially available polystyrene gel columns are used as the column. The GPC measurement conditions are as follows:

[GPC Measurement Conditions]

Instrument: LC-GPC 150C (produced by Waters Corporation)

Column: seven-column combination including Shodex KF801, 802, 803, 804, 805, 806, and 807 (produced by Showa Denko K.K.)

Column temperature: 40° C.

Mobile phase: tetrahydrofuran (THF)

Method for Measuring Content (on Mass Basis) of Segment which is Capable of Forming a Crystalline Structure The content (on a mass basis) of the segment which is capable of forming a crystalline structure (e.g., a crystalline polyester) in the block polymer is measured by 1H-NMR under the following conditions:

Measuring instrument: FT NMR instrument JNM-EX400 (produced by JEOL Ltd.)

Measurement frequency: 400 MHz

Pulse condition: 5.0 μs

Frequency range: 10500 Hz

Number of acquisitions: 64

Measurement temperature: 30° C.

Into a sample tube having an inner diameter of 5 mm, 50 mg of a sample (block polymer) is placed and deuterated chloroform ($CDCl_3$) is added thereto as a solvent. The sample is dissolved in a 40° C. thermostat to prepare a measurement sample. The measurement sample is measured under the above-described conditions and a 1H-NMR chart is obtained. From among the peaks attributable to the constitutional elements of the crystalline polyester in the obtained 1H-NMR chart, a peak independent from those peaks attributable to other constitutional elements is selected and the integrated value $S_1$ of this peak is calculated. Similarly, from among the peaks attributable to the constitutional elements of the amorphous polymer, a peak independent from those peaks attributable to other constitutional elements is selected and the integrated value $S_2$ is calculated. The crystalline polyester content (mol %) is determined by the following equation by using the integrated values $S_1$ and $S_2$, where $n_1$ and $n_2$ each represent the number of hydrogen atoms in the constitutional element to which the selected peak is attributable:

$$\text{Crystalline polyester content (mol \%)}=\{(S_1/n_1)/((S_1/n_1)+(S_2/n_2))\}\times100$$

The obtained content (mol %) is converted into mass % from the molecular weight of each component.

Method for Measuring Glass Transition Temperature (Tg) of Amorphous Resin

The glass transition temperature (Tg) of the amorphous resin is measured with a differential scanning calorimeter DSC Q1000 (produced by TA instruments) under the following conditions:

Measurement mode: modulation mode

Heating rate: 2° C./min

Modulation temperature amplitude: ±0.6° C./min

Frequency: 1/min

Measurement start temperature: 20° C.

Measurement end temperature: 150° C.

The temperature correction of the instrument detection unit is carried out by using the melting points of indium and zinc and the correction of heat quantity is carried out by using heat of fusion of the indium.

To be more specific, about 5 mg of a sample is accurately weighed, placed in a silver pan, and measured once. An empty silver pan is used as the reference. Based on the reversing heat flow curve obtained during heating, tangent lines between the curve indicating the endotherm and base lines before and after the endotherm are drawn, and a mid point of a straight line connecting the intersections of the tangent lines is determined. The temperature at this mid point is assumed to be the glass transition temperature.

Method for Measuring Melting Point of Wax

The melting point of the wax is measured with DSC Q1000 (produced by TA Instruments) under the following conditions:

Heating rate: 10° C./min

Measurement start temperature: 20° C.

Measurement end temperature: 180° C.

The temperature correction of the instrument detection unit is carried out by using the melting points of indium and zinc and the correction of heat quantity is carried out by using heat of fusion of the indium.

To be more specific, about 2 mg of a sample is accurately weighed, placed in a silver pan, and measured. An empty silver pan is used as the reference. During the measurement, the temperature is increased to 200° C., decreased to 30° C., and the increased again. During this second heating process, the temperature at which the maximum endothermic peak is observed in the DSC curve in the temperature range of 30° C. to 200° C. is assumed to be the melting point of the wax. The maximum endothermic peak refers to a peak that has the highest endothermic energy amount if there are more than one peak.

Method for Measuring Volume-Average Particle Diameter (Dv) of Resin Fine Particles The volume-average particle diameter (Dv) of the resin fine particles is measured with a Microtrac particle size distribution analyzer HRA (X-100 produced by Nikkiso Co., Ltd.) in a 0.001 to 10 μm range setting. The volume-average particle diameter (Dv) is measured as a volume-average particle diameter in terms of μm. Water is used as a diluent solvent.

Method for Measuring Weight-Average Particle Diameter (D4) and Number-Average Particle Diameter (D1) of Toner The weight-average particle diameter (D4) and number-average particle diameter (D1) of the toner are measured as follows.

A precision particle size distribution analyzer equipped with a 100 μm aperture tube based on an aperture resistance method, namely, COULTER COUNTER Multisizer 3 (registered trade mark, product of Beckman Coulter Inc.) is used as the measuring instrument. Setting of the measurement conditions and analysis of the measurement data are conducted through attached special software Beckman Coulter Multisizer 3 version 3.51 produced by Beckman Coulter Inc. The number of effective measurement channels during the measurement is 25,000.

The aqueous electrolytic solution used in the measurement is, for example, a solution prepared by dissolving special grade sodium chloride in ion exchange water so that the concentration is about 1 mass %, e.g., ISOTON II produced by Beckman Coulter Inc.

Before conducting the measurement and analysis, the special software is set as follows:

Set the total count of the control mode appearing in a "Change standard operating method (SOM)" window of the software to 50,000 particles. Set the number of runs to 1 and Kd value to a value obtained by using "Standard particles 10.0 μm" produced by Beckman Coulter Inc. Press "Threshold/Noise level measurement button" to automatically set the threshold and the noise level. Set the current to 1600 μA, gain to 2, and electrolyte to ISTON II. Check the "Flush aperture tube after run" box.

In the "Convert Pulse to Size Settings" window of the software, set the bin spacing to log diameter, size bin to 256 size bin, and size range to 2 μm to 60 μm.

A specific measurement method is as follows:

(1) Into a 250 mL round-bottomed glass beaker specially prepared for Multisizer 3, about 200 mL of the aqueous electrolytic solution is placed, the beaker is set in the sample stand, and anticlockwise stirring using a stirrer rod is conducted at 24 rotations/second. The contaminants and bubbles inside the aperture tube are preliminarily removed by "aperture flush" function of the software.

(2) Into a 100 mL flat-bottomed glass beaker, about 30 mL of the aqueous electrolytic solution is placed and about 0.3 mL of a diluted solution of a dispersing agent, "Contaminon N" (a 10 mass % aqueous solution of a neutral detergent for washing precision measurement instruments having pH of 7 and containing a nonionic surfactant, an anionic surfactant, and an organic builder, produced by Wako Pure Chemical Industries) diluted about 3 fold with ion exchange water on a mass basis is added thereto.

(3) An ultrasonic disperser, Ultrasonic Dispersion System Tetora 150 produced by Nikkaki Bios Co., Ltd., equipped with two oscillators having an oscillation frequency of 50 kHz with a 180 degree phase shift and an electrical output of 120 W is prepared. About 3.3 L of ion exchange water is placed in a water tank of the ultrasonic disperser and about 2 mL of Contaminon N is added to the water tank.

(4) The beaker prepared in (2) is set in a beaker securing hole of the ultrasonic disperser and the ultrasonic disperser is operated. The height position of the beaker is adjusted so that the resonant state of the liquid surface of the aqueous electrolytic solution in the beaker is maximum.

(5) While applying ultrasonic waves to the electrolyte aqueous solution in the beaker in (4), about 10 mg of the toner is added to the aqueous electrolytic solution in small divided portions to conduct dispersion. The ultrasonic dispersion treatment is continued further for 60 seconds. During the process of ultrasonic dispersion, the water temperature of the water tank is adjusted to be in a range of 10° C. or more and 40° C. or less.

(6) The ultrasonically dispersed aqueous electrolytic solution containing dispersed toner prepared in (5) is added dropwise using a pipette to the round-bottomed beaker prepared in (1) installed in the sample stand to adjust the measurement concentration to about 5%. Run is repeated until the count of particles reaches 50,000.

(7) The measurement data is analyzed with special software installed in the instrument to calculate the weight-average particle diameter (D4) and the number-average particle diameter (D1). The weight-average particle diameter (D4) is the number in "Average Diameter" of the "Analysis/volume statistic values (arithmetic mean)" window on Graph/Volume % setting, and the number-average particle diameter (D1) is the number in "Average Diameter" of the "Analysis/number statistic values (arithmetic mean)" window on Graph/Number % setting.

EXAMPLES

The present invention will now be described in detail by way of Examples and Comparative Examples which do not limit the scope of the present invention. The "parts" and "%" in Examples and Comparative Examples are on a mass basis unless otherwise noted.

Synthesis of Aliphatic Polyester 1

Into a heat-dried two-necked flask, the following raw materials were fed while introducing nitrogen:

| | |
|---|---|
| Sebacic acid | 134.0 parts by mass |
| 1,4-Butanediol | 66.0 parts by mass |
| Dibutyltin oxide | 0.1 parts by mass |

The system was purged with nitrogen by reducing the pressure and stirring was conducted for 6 hours at 180° C. While the stirring was continued, the temperature was slowly increased to 230° C. under a reduced pressure and retained thereat for 2 hours. After the content of the flask became viscous, the content was air cooled to terminate the reaction. As a result, an aliphatic polyester 1 was synthesized. The physical properties of the aliphatic polyester 1 are shown in Table 2.

Synthesis of Aliphatic Polyesters 2 to 8

Aliphatic polyesters 2 to 8 were synthesized as in synthesizing the aliphatic polyester 1 except that the feeding of the raw materials were changed as shown in Table 2. The physical properties of the aliphatic polyesters 2 to 8 are shown in Table 2.

TABLE 1

| | Amounts of raw materials (parts by mass) | | | | | | |
|---|---|---|---|---|---|---|---|
| | Sebacic acid | 1,10-Decane-dicarboxylic acid | 1,16-Hexadecane-dicarboxylic acid | 1,4-Butanediol | 1,6-Hexanediol | 1,9-Nonanediol | Alcohol/acid molar ratio |
| Aliphatic polyester 1 | 134.0 | — | — | 66.0 | — | — | 1.11 |
| Aliphatic polyester 2 | 121.0 | — | — | — | 79.0 | — | 1.12 |
| Aliphatic polyester 3 | — | 126.5 | — | — | 73.5 | — | 1.13 |
| Aliphatic polyester 4 | 105.5 | — | — | — | — | 94.5 | 1.13 |
| Aliphatic polyester 5 | — | — | 150.0 | 50.0 | — | — | 1.16 |
| Aliphatic polyester 6 | — | — | 140.0 | — | 60.0 | — | 1.14 |
| Aliphatic polyester 7 | 136.5 | — | — | 63.5 | — | — | 1.04 |
| Aliphatic polyester 8 | 137.5 | — | — | 62.5 | — | — | 1.02 |

TABLE 2

| | Mn | Mw | Mw/Mn | Endothermic peak temperature Tp (° C.) | Ester group concentration (mmol/g) |
|---|---|---|---|---|---|
| Aliphatic polyester 1 | 2500 | 4500 | 1.8 | 66 | 7.8 |
| Aliphatic polyester 2 | 2500 | 4400 | 1.8 | 69 | 7.0 |
| Aliphatic polyester 3 | 2400 | 4500 | 1.9 | 73 | 6.3 |
| Aliphatic polyester 4 | 2600 | 4800 | 1.8 | 75 | 6.0 |
| Aliphatic polyester 5 | 2400 | 4400 | 1.8 | 83 | 5.4 |
| Aliphatic polyester 6 | 2800 | 5100 | 1.8 | 85 | 5.0 |
| Aliphatic polyester 7 | 5800 | 12800 | 2.2 | 66 | — |
| Aliphatic polyester 8 | 12700 | 59000 | 4.6 | 65 | — |

Synthesis of Vinyl Monomer (y1) Having Aliphatic Polyester Structure

Into a reactor equipped with a stirring rod and a thermometer, 59.0 parts by mass of xylylene diisocyanate (XDI) was fed, and 41.0 parts by mass of 2-hydroxyethyl methacrylate was added thereto dropwise. The reaction was conducted at 55° C. for 4 hours. As a result, a monomer intermediate was obtained.

Into a reactor equipped with a stirring rod and a thermometer, 83.0 parts by mass of the aliphatic polyester 1 and 100.0 parts by mass of tetrahydrofuran (THF) were fed and the aliphatic polyester 1 was dissolved at 50° C. Then 10.0 parts by mass of the monomer intermediate was added thereto dropwise and the reaction was conducted at 50° C. for 4 hours. As a result, a vinyl monomer (y1) solution was obtained. The solvent THF was distilled away and a vinyl monomer (y1) was obtained.

Synthesis of Vinyl Monomers (y2) to (y6) Having Aliphatic Polyester Structures

Vinyl monomers (y2) to (y6) were synthesized as in synthesizing the vinyl monomer (y1) except that the aliphatic polyester 1 was changed to the aliphatic polyesters 2 to 6.

Preparation of Vinyl Monomers (z1) to (z5) Having Organic Polysiloxane Structures Commercially available methacryl-modified polysiloxane products shown in Table 3 were prepared and used as vinyl monomers (z1) to (z5) having organic polysiloxane structures. For example, the vinyl monomer (z1) is represented by formula (2) below with $R_7$ to $R_{11}$ and $R_{13}$ each representing a methyl group, $R_{12}$ representing a propylene group, and n (degree of polymerization) representing 3.

[Chem. 5]

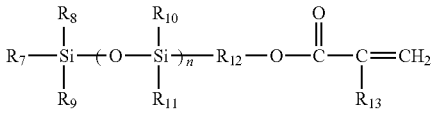

(2)

TABLE 3

| | Product name | Manufacturer | Molecular weight | $R_8$ | $R_9$ | $R_{10}$ | $R_{11}$ | $R_{13}$ | Degree of polymerization n |
|---|---|---|---|---|---|---|---|---|---|
| Vinyl monomer (z1) | X-22-2475 | Shin-Etsu Chemical Co., Ltd. | 420 | Methyl group | Methyl group | Methyl group | Methyl group | Methyl group | 3 |
| Vinyl monomer (z2) | FM-0711 | Chisso Corporation | 1000 | Methyl group | Methyl group | Methyl group | Methyl group | Methyl group | 11 |
| Vinyl monomer (z3) | FM-0721 | Chisso Corporation | 5000 | Methyl group | Methyl group | Methyl group | Methyl group | Methyl group | 65 |
| Vinyl monomer (z4) | FM-0725 | Chisso Corporation | 10000 | Methyl group | Methyl group | Methyl group | Methyl group | Methyl group | 133 |
| Vinyl monomer (z5) | X-22-2426 | Shin-Etsu Chemical Co., Ltd. | 12000 | Methyl group | Methyl group | Methyl group | Methyl group | Methyl group | 160 |

Preparation of Resin Fine Particle Dispersion 1 for Forming Shells

The following raw materials were fed to a beaker, stirred at 20° C., and mixed to prepare a monomer solution.

| | |
|---|---|
| Vinyl monomer (y4) | 40.0 parts by mass |
| Vinyl monomer (z1) | 15.0 parts by mass |
| Methacrylic acid (MAA) | 10.0 parts by mass |

-continued

| | |
|---|---|
| Styrene (St) | 35.0 parts by mass |
| Azobismethoxydimethylvaleronitrile | 0.3 parts by mass |
| Normal hexane | 80.0 parts by mass |

Into a previously heat-dried dropping funnel, the monomer solution was introduced. Into a separate heat-dried two-necked flask, 800.0 parts by mass of normal hexane was fed. After nitrogen purging, the dropping funnel was installed to the two-necked flask, and the monomer solution was added dropwise at 40° C. in 1 hour in a closed system. After completion of the dropwise addition, stirring was continued for 3 hours. A mixture of 0.3 parts by mass of azobismethoxydimethylvaleronitrile and 20.0 parts by mass of normal hexane was again added thereto dropwise, and stirring was conducted at 40° C. for 3 hours. The resulting mixture was cooled to room temperature. As a result, a resin fine particle dispersion 1 for forming shells having a solid content of 10.0 mass % and containing fine particles 1 for forming shells was obtained. The physical properties of the resin fine particles 1 for forming shells are shown in Table 4.

Preparation of Resin Fine Particle Dispersions 2 to 23 for Forming Shells

The resin fine particle dispersions 2 to 23 (solid content: 10.0 mass %) for forming shells that contained the resin fine particles 2 to 23 for forming shells were prepared as in preparing the resin fine particle dispersion 1 for forming shells except that the feeding of the raw materials was changed as shown in Table 4. The physical properties of the resin fine particles 2 to 23 for forming shells are shown in Table 4.

TABLE 4

| | Vinyl monomer (y) | | Vinyl monomer (z) | | Additional vinyl monomer | | | | | |
|---|---|---|---|---|---|---|---|---|---|---|
| | Type | Monomer ratio (parts by mass) | Type | Monomer ratio (parts by mass) | MAA (parts by mass) | St (parts by mass) | BEA (parts by mass) | MMA (parts by mass) | Fine particle diameter Dv (μm) | Mw |
| Resin fine particles 1 for forming shells | y4 | 40.0 | z1 | 15.0 | 10.0 | 35.0 | — | — | 0.13 | 60,400 |
| Resin fine particles 2 for forming shells | y3 | 40.0 | z1 | 15.0 | 10.0 | 35.0 | — | — | 0.12 | 61,500 |
| Resin fine particles 3 for forming shells | y5 | 40.0 | z1 | 15.0 | 10.0 | 35.0 | — | — | 0.12 | 59,600 |
| Resin fine particles 4 for forming shells | y6 | 40.0 | z1 | 15.0 | 10.0 | 35.0 | — | — | 0.13 | 64,400 |
| Resin fine particles 5 for forming shells | y4 | 40.0 | z2 | 15.0 | 10.0 | 35.0 | — | — | 0.13 | 62,200 |
| Resin fine particles 6 for forming shells | y4 | 40.0 | z3 | 15.0 | 10.0 | 35.0 | — | — | 0.15 | 58,500 |
| Resin fine particles 7 for forming shells | y4 | 20.0 | z1 | 15.0 | 10.0 | 55.0 | — | — | 0.14 | 63,200 |
| Resin fine particles 8 for forming shells | y4 | 13.0 | z1 | 15.0 | 10.0 | 62.0 | — | — | 0.15 | 63,700 |
| Resin fine particles 9 for forming shells | y4 | 45.0 | z1 | 15.0 | 10.0 | 30.0 | — | — | 0.14 | 61,200 |
| Resin fine particles 10 for forming shells | y4 | 55.0 | z1 | 15.0 | 10.0 | 20.0 | — | — | 0.13 | 62,800 |
| Resin fine particles 11 for forming shells | y4 | 40.0 | z1 | 10.0 | 10.0 | 40.0 | — | — | 0.13 | 60,800 |
| Resin fine particles 12 for forming shells | y4 | 40.0 | z1 | 4.0 | 10.0 | 46.0 | — | — | 0.12 | 61,300 |
| Resin fine particles 13 for forming shells | y4 | 40.0 | z1 | 20.0 | 10.0 | 30.0 | — | — | 0.15 | 60,100 |
| Resin fine particles 14 for forming shells | y4 | 40.0 | z1 | 28.0 | 10.0 | 22.0 | — | — | 0.14 | 63,600 |
| Resin fine particles 15 for forming shells | y4 | 40.0 | z1 | 15.0 | — | 45.0 | — | — | 0.14 | 59,200 |
| Resin fine particles 16 for forming shells | y4 | 40.0 | z1 | 15.0 | 10.0 | — | — | 35.0 | 0.16 | 61,100 |
| Resin fine particles 17 for forming shells | — | — | — | — | 10.0 | — | 75.0 | 15.0 | 0.13 | 62,800 |
| Resin fine particles 18 for forming shells | — | — | z1 | 28.0 | 15.0 | — | 57.0 | — | 0.14 | 58,900 |
| Resin fine particles 19 for forming shells | y4 | 60.0 | — | — | 15.0 | — | 25.0 | — | 0.13 | 63,100 |
| Resin fine particles 20 for forming shells | y4 | 40.0 | z4 | 25.0 | 10.0 | 25.0 | — | — | 0.13 | 62,500 |
| Resin fine particles 21 for forming shells | y4 | 40.0 | z5 | 25.0 | 10.0 | 25.0 | — | — | 0.15 | 61,300 |
| Resin fine particles 22 for forming shells | y2 | 50.0 | z1 | 15.0 | 10.0 | 25.0 | — | — | 0.14 | 61,800 |
| Resin fine particles 23 for forming shells | y1 | 50.0 | z1 | 15.0 | 10.0 | 25.0 | — | — | 0.15 | 62,300 |

Note:
MAA: methacrylic acid
St: styrene
BEA: behenyl acrylate
MMA; methyl methacrylate Synthesis of Block Polymer 1

Into a reactor equipped with a stirrer and a thermometer, the following raw materials were fed under nitrogen purge:

| | |
|---|---|
| Aliphatic polyester 7 | 210.0 parts by mass |
| Xylylene diisocyanate (XDI) | 56.0 parts by mass |
| Cyclohexanedimethanol (CHDM) | 34.0 parts by mass |
| Tetrahydrofuran (THF) | 300.0 parts by mass |

The content was heated to 50° C. and a urethanation reaction was carried out for 15 hours. Then 3.0 parts by mass of tertiary butyl alcohol was added to modify the isocyanate termini. The solvent THF was distilled away. As a result, a block polymer 1 was synthesized. The block polymer 1 had Mn of 11,800, Mw of 27,400, and a peak temperature (Tp) of the maximum endothermic peak of 58° C.

Synthesis of Block Polymer 2

A block polymer 2 was synthesized as in synthesizing the block polymer 1 except that the feeding of the raw materials was changed as follows.

| | |
|---|---|
| Aliphatic polyester 7 | 135.0 parts by mass |
| Xylylene diisocyanate (XDI) | 97.0 parts by mass |
| Cyclohexanedimethanol (CHDM) | 68.0 parts by mass |
| Tetrahydrofuran (THF) | 300.0 parts by mass |

The block polymer 2 had Mn of 14,700, Mw of 33,500, and a peak temperature (Tp) of the maximum endothermic peak of 58° C.

Synthesis of Amorphous Resin 1

Into s heat-dried two-necked flask, the following raw materials were fed while introducing nitrogen:

| | |
|---|---|
| Polyoxypropylene (2.2)-2,2-bis(4-hydroxyphenyl)propane | 30.0 parts by mass |
| Polyoxyethylene (2.2)-2,2-bis(4-hydroxyphenyl)propane | 34.0 parts by mass |
| Terephthalic acid | 30.0 parts by mass |
| Fumaric acid | 6.0 parts by mass |
| Dibutyltin oxide | 0.1 parts by mass |

The system was purged with nitrogen by reducing the pressure, and stirring was conducted at 215° C. for 5 hours. Then the temperature was slowly increased to 230° C. while stirring at a reduced pressure and retained thereat for 2 hours. After the content in the flask became viscous, the content was air cooled to terminate the reaction. As a result, an amorphous resin 1, which is an amorphous polyester, was synthesized. The amorphous resin 1 had a number-average molecular weight (Mn) of 2,200, a weight-average molecular weight (Mw) of 9,800, and a glass transition temperature (Tg) of 60° C.

Synthesis of Amorphous Resin 2

An amorphous resin 2 was synthesized as in synthesizing the amorphous resin 1 except that the feeding of the raw materials was changed as follows:

| | |
|---|---|
| Polyoxypropylene (2.2)-2,2-bis(4-hydroxyphenyl)propane | 30.0 parts by mass |
| Polyoxyethylene (2.2)-2,2-bis(4-hydroxyphenyl)propane | 33.0 parts by mass |
| Terephthalic acid | 21.0 parts by mass |
| Trimellitic anhydride | 1.0 part by mass |
| Fumaric acid | 3.0 parts by mass |
| Dodecenylsuccinic acid | 12.0 parts by mass |
| Dibutyltin oxide | 0.1 parts by mass |

The amorphous resin 2 had Mn of 7,200, Mw of 43,000, and Tg of 63° C.

Synthesis of Amorphous Resin 3

Into a reactor equipped with a stirrer and a thermometer, the following raw materials were fed under nitrogen purge:

| | |
|---|---|
| Xylylene diisocyanate (XDI) | 117.0 parts by mass |
| Cyclohexanedimethanol (CHDM) | 83.0 parts by mass |
| Acetone | 200.0 parts by mass |

The content was heated to 50° C. and a urethanation reaction was carried out for 15 hours. Then 3.0 parts by mass of tertiary butyl alcohol was added to modify the isocyanate termini. The solvent acetone was distilled away. As a result, an amorphous resin 3 was synthesized. The amorphous resin 3 had Mn of 4,400 and Mw of 20,000.

Preparation of Block Polymer Solution 1

Into a beaker equipped with a stirrer, 500.0 parts by mass of acetone and 500.0 parts by mass of the block polymer 1 were fed and stirring was conducted until the block polymer 1 was completely dissolved. As a result, a block polymer solution 1 was prepared.

Preparation of Block Polymer Solution 2

A block polymer solution 2 was prepared as in preparing the block polymer solution 1 except that the block polymer 1 was changed to the block polymer 2.

Preparation of Aliphatic Polyester Resin Solution 1

Into a beaker equipped with a stirrer, 500.0 parts by mass of THF and 500.0 parts by mass of the aliphatic polyester 8 were fed and stirring was conducted at 40° C. until the aliphatic polyester 8 was completely dissolved. As a result, an aliphatic polyester resin solution 1 was obtained.

Preparation of Amorphous Resin Solution 1

Into a beaker equipped with a stirrer, 500.0 parts by mass of acetone and 500.0 parts by mass of the amorphous resin 3 were fed and stirring was continued at 40° C. until the amorphous resin 3 was completely dissolved. As a result, an amorphous resin solution 1 was obtained.

Preparation of Amorphous Resin Solution 2

An amorphous resin solution 2 was prepared as in preparing the amorphous resin solution 1 except that the 500.0 parts by mass of the amorphous resin 3 was chanted to 400.0 parts by mass of the amorphous resin 1 and 100.0 parts by mass of the amorphous resin 2.

Preparation of Colorant Particle Dispersion 1

The following materials were placed in a heat-resistant glass container:

| | |
|---|---|
| C.I. Pigment Blue 15:3 | 100.0 parts by mass |
| Acetone | 150.0 parts by mass |
| Glass beads (1 mm) | 300.0 parts by mass |

Dispersion was conducted for 5 hours using a paint shaker (produced by Toyo Seiki Seisaku-Sho, Ltd.), glass beads were removed with a nylon mesh, and a colorant particle dispersion 1 having a solid content of 40.0 mass % was obtained.

Preparation of Wax Particle Dispersion 1

The following raw materials were placed in a glass beaker (produced by Iwaki Glass Co., Ltd.) equipped with a stirring blade:

| | |
|---|---|
| Paraffin wax HNP10 (peak temperature of main endothermic peak: 75° C., product of Nippon Seiro Co., Ltd.) | 16.0 parts by mass |
| Wax dispersing agent (a copolymer having a peak molecular weight of 8,500 obtained by graft copolymerization of 50.0 parts by mass of styrene, 25.0 parts by mass of n-butyl acrylate, and 10.0 parts by mass of acrylonitrile in the presence of 15.0 parts by mass of polyethylene) | 8.0 parts by mass |
| Acetone | 76.0 parts by mass |

The system was heated to 70° C. to dissolve the paraffin wax in acetone. Then the system was slowly cooled under moderate stirring at 50 rpm to 25° C. in 3 hours. As a result, an opal liquid was obtained.

This liquid was fed to a heat resistant container along with 20 parts by mass of 1 mm glass beads. Dispersion was conducted for 3 hours in a paint shaker. As a result, a wax particle dispersion 1 containing 16.0 mass % (on a solid content basis) of wax particles having a volume average particle diameter of 0.27 μm was obtained.

Example 1

Production of Pretreatment Particles

Referring to the experiment apparatus shown in FIG. 1, valves V1 and V2 and a pressure regulating valve V3 were closed, the resin fine particle dispersion 1 for forming shells was fed to a granulation tank T1 equipped with a stirrer mechanism and a filter for capturing toner particles, and the inner temperature was adjusted to 25° C. Then the valve V1 was opened, carbon dioxide (99.99% purity) was introduced from a cylinder B1 to the granulation tank T1 by using a pump P1, and the valve V1 was closed after the inner pressure reached 4 MPa.

The block polymer solution 1, the wax dispersion 1, the colorant particle dispersion 1, and acetone were fed to a resin solution tank T2 and the inner temperature was adjusted to 25° C.

The valve V2 was opened, the content of the resin solution tank T2 was introduced into the granulation tank T1 by using a pump P2 while stirring the content of the granulation tank T1 at 2000 rpm, and the valve V2 was closed after all of the content of the resin solution tank T2 was introduced. The inner pressure of the granulation tank T1 after the introduction was 5 MPa.

The amounts (mass ratios) of the materials fed were as follows:

| | |
|---|---|
| Resin fine particle dispersion 1 for forming shells | 87.0 parts by mass |
| Block polymer solution 1 | 182.0 parts by mass |
| Colorant particle dispersion 1 | 12.5 parts by mass |
| Wax particle dispersion 1 | 25.0 parts by mass |
| Acetone | 30.5 parts by mass |
| Carbon dioxide | 480.0 parts by mass |

The mass of carbon dioxide introduced was calculated by determining the density of carbon dioxide from the state equation described in Journal of Physical and Chemical Reference data, vol. 25, pp. 1509-1596, based on the temperature (25° C.) and pressure (5 MPa) of carbon dioxide and multiplying the obtained density by the volume of the granulation tank T1. After the completion of the introduction of the content of the resin solution tank T2 into the granulation tank T1, stirring was conducted for 10 minutes at 2000 rpm to carry out granulation.

Next, the valve V1 was opened and carbon dioxide was introduced into the granulation tank T1 from the cylinder B1 using the pump P1. During this process, the pressure regulating valve V3 was set to 10 MPa and carbon dioxide was distributed while retaining the inner pressure of the granulation tank T1 to 10 MPa. As a result of this operation, carbon dioxide containing the organic solvent (mainly acetone) extracted from the droplets after granulation was discharged to a solvent recovery tank T3 and the organic solvent was separated from carbon dioxide.

Introduction of carbon dioxide into the granulation tank T1 was terminated when the mass of carbon dioxide introduced reached five times that of carbon dioxide initially introduced into the granulation tank T1. At this point, operation of replacing the organic-solvent-containing carbon dioxide with organic-solvent-free carbon dioxide was completed.

The pressure regulating valve V3 was gradually opened and the inner pressure of the granulation tank T1 was decreased to atmospheric pressure to obtain pretreatment particles 1 captured by the filter. The pretreatment particles 1 were analyzed by DSC and the peak temperature of the maximum endothermic peak was found to be 58° C.

Annealing Treatment

The annealing treatment was conducted with a constant-temperature drying oven (41-S5 produced by Satake Chemical Equipment MFG., Ltd.). First, the inner temperature of the constant-temperature drying oven was adjusted to 50° C. Then the pretreatment particles 1 were placed in a stainless steel vat so as to be spread evenly, put in the constant-temperature drying oven, left in the oven for 2 hours, and discharged from the oven. As a result, annealed toner particles (treated) 1 were obtained. The toner particles (treated) obtained were analyzed by XRF to determine the Si content and were thereby confirmed to contain 8.0 mass % of the resin derived from the resin fine particles for forming shells. Determination of the Si content by ESCA confirmed that the 95% of the surfaces of the particles were coated with the resin derived from the resin fine particles for forming shells.

Preparation of Toner

In a Henschel mixer (produced by Mitsui Kozan Co., Ltd.), 100.0 parts by mass of the toner particles (treated) 1, 1.8 parts by mass of hydrophobic silica fine powder (number-average primary particle diameter: 7 nm) treated with hexamethyldisilazane, and 0.15 parts by mass of rutile titanium oxide fine powder (number-average primary particle diameter: 30 nm) were dry-mixed for 5 minutes to obtain a toner 1.

Examples 2 to 16

Pretreatment particles 2 to 16 were obtained as in Example 1 except that the resin fine particle dispersions 2 to 16 for forming shells were used instead of the resin fine particle dispersion 1 for forming shell used in the process of producing the pretreatment particles. The annealing treatment was performed as in Example 1 to obtain toners 2 to 16.

Example 17

Pretreatment particles 17 were obtained as in Example 1 except that the feed amount of the resin fine particle dispersion 1 for forming shells in the process of producing the pretreatment particles was changed to 20.4 parts by mass. The annealing treatment was performed as in Example 1 to obtain a toner 17.

Example 18

Pretreatment particles 18 were obtained as in Example 1 except that the feed amount of the resin fine particle dispersion 1 for forming shells in the process of producing the pretreatment particles was changed to 52.6 parts by mass. The annealing treatment was performed as in Example 1 to obtain a toner 18.

Example 19

Pretreatment particles 19 were obtained as in Example 1 except that the feed amount of the resin fine particle dispersion 1 for forming shells in the process of producing the pretreatment particles was changed to 136.4 parts by mass. The annealing treatment was performed as in Example 1 to obtain a toner 19.

Example 20

Pretreatment particles 20 were obtained as in Example 1 except that the feed amount of the resin fine particle dispersion 1 for forming shells in the process of producing the pretreatment particles was changed to 219.5 parts by mass. The annealing treatment was performed as in Example 1 to obtain a toner 20.

Example 21

Pretreatment particles 21 were obtained as in Example 1 except that the block polymer solution 2 was used instead of the block polymer solution 1 in the process of producing the pretreatment particles. The annealing treatment was performed as in Example 1 to obtain a toner 21.

Example 22

Pretreatment particles 22 were obtained as in Example 1 except that 81.9 parts by mass of the aliphatic polyester resin solution and 100.1 parts by mass of the amorphous resin solution 1 were used instead of 182.0 parts by mass of the block polymer solution 1 in the process of producing the pretreatment particles. The annealing treatment was performed as in Example 1 to obtain a toner 22.

Comparative Examples 1 to 7

Pretreatment particles 23 to 29 were obtained as in Example 1 except that the resin fine particle dispersions 17 to 23 for forming shells were used instead of the resin fine particle dispersion 1 for forming shells in the process of producing the pretreatment particles. The annealing treatment was conducted as in Example 1 to obtain toners 23 to 29 used for comparison.

Comparative Example 8

Pretreatment particles 30 were obtained as in Example 1 except that 55.6 parts by mass of the resin fine particle dispersion 18 for forming shells and 55.6 parts by mass of the resin fine particle dispersion 19 for forming shells were used instead of 87.0 parts by mass of the resin fine particle dispersion 1 for forming shell in the process of producing the pretreatment particles and that the amorphous resin solution 2 was used instead of the block polymer solution 1. The pretreatment particles 30 were not annealed and formed into a toner 30 used for comparison by the same toner-producing process described in Example 1.

The physical properties of the toners 1 to 30 obtained as such as shown in Table 5. The toner particles (treated) produced by using the resin fine particles for forming shells containing the vinyl monomer (z) as a constituent material were confirmed to be particles covered with the resin derived from the resin fine particles for forming shells by determining the Si content through ESCA. For other toner particles (treated), the presence of the resin fine particles for forming shells on the surfaces was confirmed by observation with a scanning electron microscope (SEM).

The toners 1 to 30 were left in a room temperature, normal humidity environment (23° C., 60% RH) for 24 hours and evaluation was conducted according to the following procedure. The evaluation results are shown in Table 6.

Method for Evaluating Toner

Low-Temperature Fixability

The low-temperature fixability was evaluated by using a commercially available printer, LBP5300 manufactured by CANON KABUSHIKI KAISHA. LBP5300 employs monocomponent contact development and regulates the amount of toner on a development bearing member by using a toner regulating member. A cartridge for evaluation was prepared by removing the toner from a commercially available cartridge, cleaning the inside of the cartridge by blowing air, and placing the toner in the cleaned cartridge. The cartridge was mounted in a cyan station and dummy cartridges were mounted in other stations.

Then an unfixed solid toner image (the amount of toner loaded per unit area: 1.2 mg/cm$^2$) having a front margin of 5 mm, a width of 100 mm, and a length of 25 mm was formed on a thick A4 paper sheet (Plover Bond paper: 105 g/m$^2$, produced by Fox River Paper Company).

A fixing unit of a commercially available printer LBP5900 produced by CANON KABUSHIKI KAISHA, was modified so that the fixing temperature could be set manually. The speed of rotation of the fixing unit was changed to 245 mm/s and the nip pressure was changed to 98 kPa. The solid unfixed image was fixed onto the paper sheet in a room temperature, normal humidity environment (23° C., 60% RH) while increasing the fixing temperature from 80° C. to 130° C. at an increment of 5° C. so as to obtain fixed solid images at different temperatures.

The low-temperature fixability was evaluated in terms of a fixing onset temperature determined by the cold offset property.

In particular, the solid portion of the fixed image obtained as above was evaluated in terms of the density change of the portion that forms a background which is behind the edge in the circumferential direction by the distance equal to one turn of the fixing belt. The density was measured by measuring the reflectance (%) with DENSITOMETER TC-6DS produced by Tokyo Denshoku Co., Ltd., Technical Center and assuming the reflectance to be the density. The temperature at which the density changed 0.5% was assumed to be the point at which the cold offset occurred. The lowest temperature that did not cause cold offset was assumed to be the fixing onset temperature.

The evaluation standard is as follows. The ratings A, B, and C indicate acceptable levels satisfactory. The rating D is considered as failing to achieve the effect of the present invention.

A: Fixing onset temperature was less than 100° C.

B: Fixing onset temperature was 100° C. or more and less than 110° C.

C: Fixing onset temperature was 110° C. or more and less than 120° C.

D: Fixing onset temperature was 120° C. or more (Stability of Fixed Image)

An unfixed toner image (the amount of toner loaded per unit area: 1.2 mg/cm$^2$) was formed as in the evaluation of the low-temperature fixability by using LBP5300 printer produced by CANON KABUSHIKI KAISHA.

A fixing unit removed from the BP5900 printer produced by CANON KABUSHIKI KAISHA was modified and fixing of the unfixed image was carried out in a room temperature, normal humidity environment (23° C., 60% RH) with the modified fixing unit at a speed of rotation of 245 mm/s, a nip pressure of 98 kPa, and a fixing temperature of 110° C.

A soft thin paper sheet (e.g., Dusper (trade name) produced by Ozu Corporation) was placed on an image region of the obtained fixed image and the image was rubbed through the thin paper sheet under a load of 14.7 kPa (150 g/cm$^2$) by 10 reciprocal motions.

The image density was measured before and after the rubbing and the rate of decrease ΔD (%) in image density was calculated from the equation below and assumed to be the indicator of the fixed image stability.

The image density was measured by color reflection densitomer X-Rite 404A produced by X-Rite.

$$\Delta D(\%)=\{(\text{image density before rubbing}-\text{image density after rubbing})/\text{image density before rubbing}\}\times 100$$

The evaluation standard is as follows:

A: Rate of decrease in image density (ΔD) was less than 3%

B: Rate of decrease in image density (ΔD) was 3% or more and less than 5%

C: Rate of decrease in image density (ΔD) was 5% or more and less than 10%

D: Rate of decrease in image density (ΔD) was 10% or more

Charge Stability

Preparation of Samples

Into a plastic bottle with a lid, 1.0 g of a toner and 19.0 g of a carrier (spherical carrier N-01 prepared by surface-treating ferrite cores, standard carrier designated by the Imaging Society of Japan) were placed and left in a room temperature, normal humidity environment (23° C., 60% RH) for 5 days.

Measuring the Amount of Charge

The plastic bottle containing the carrier and the toner was covered with the lid, shaken for 1 minute at a speed of 4 reciprocal motions per second using a shaker (US-LD produced by Yayoi Co., Ltd.) to charge the developer containing the toner and the carrier. Then the amount of triboelectric charge was measured with an instrument for measuring the amount of triboelectric charge shown in FIG. 2.

Figure 2:
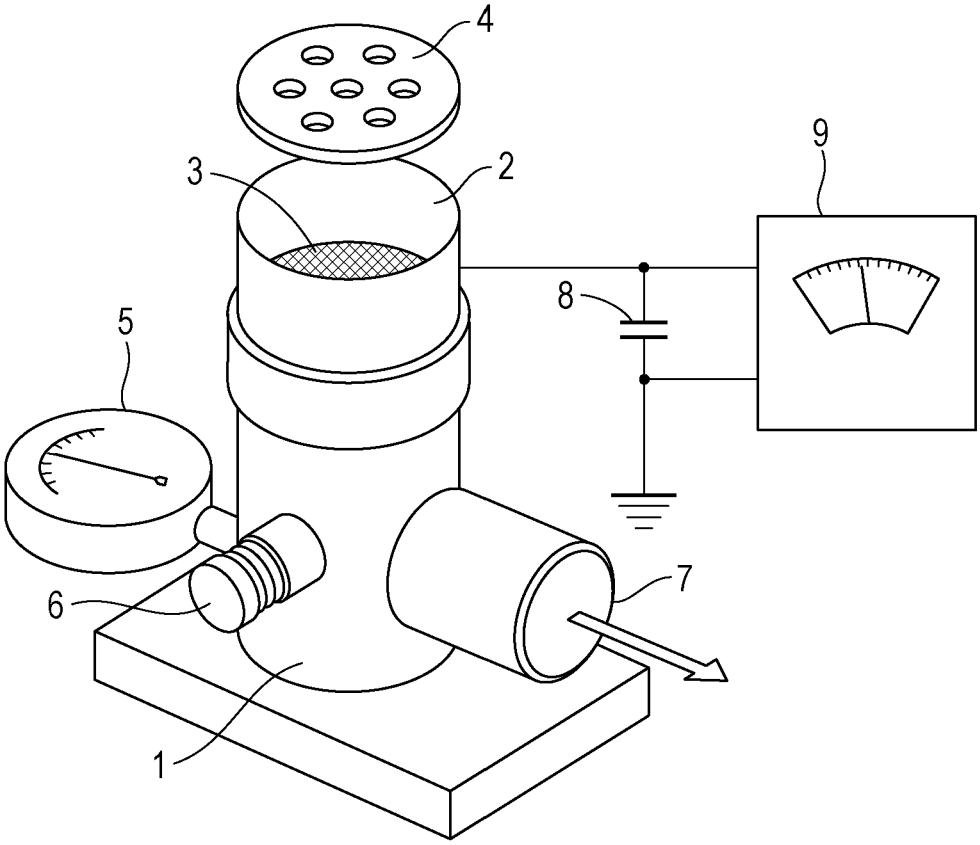
FIG. 2 is a diagram illustrating an example of an apparatus for measuring the amount of charge of the toner.

Referring to FIG. 2, 0.5 g or more and 1.5 g or less of the developer was placed in a metal measurement container 2 equipped with a 20 μm screen 3 at the bottom, and a metal lid 4 was closed. The total mass of the measurement container 2 was accurately weighed and assumed to be W1 (g). Next, a suction unit 1 (at least the portion in contact with the measurement container 2 was composed of an insulator) was operated to conduct suction from a suction port 7 while adjusting an air volume controlling valve 6 so that the pressure indicated by a vacuum meter 5 was 2.5 kPa. Under such conditions, suction was conducted for 2 minutes to remove the toner by suction. The potential indicated in a potentiometer 9 was assumed to be V (V). The potentiometer 9 was connected to a capacitor 8 having a capacity of C (mF). The mass of the entire measurement container 2 after the suction was accurately weighed and assumed to be W2 (g). The amount Q (mC/kg) of triboelectric charge of the sample is calculated from the following relationship:

$$\text{Amount of triboelectric charge } Q\ (\text{mC/kg})=C\times V/(W1-W2)$$

The amount of triboelectric charge of the sample immediately after shaking in a room temperature, normal humidity environment (23° C., 60% RH) was assumed to be Q1 (mC/kg) and the amount of triboelectric charge of the sample after being left to stand 5 days after the completion of the shaking was assumed to be Q2 (mC/kg). The charge retention ratio (Q2/Q1) after the sample was left standing was used as the indicator of the environmental stability.

The evaluation standard is as follows:

A: Charge retention ratio (Q2/Q1) was 0.90 or more and 1.00 or less

B: Charge retention ratio (Q2/Q1) was 0.80 or more and less than 0.90

C: Charge retention ratio (Q2/Q1) was 0.70 or more and less than 0.80

D: Charge retention ratio (Q2/Q1) was less than 0.70

Environmental Stability

Preparation of Samples

Into a plastic bottle with a lid, 1.0 g of a toner and 19.0 g of a particular carrier (spherical carrier N-01 prepared by surface-treating ferrite cores, standard carrier designated by the Imaging Society of Japan) were placed and left in an LL environment of 15° C. and 10% RH or in a HH environment of 32.0° C. and 85% RH for 5 days.

Measuring the Amount of Charge

A developer containing the toner and the carrier was charged according to the procedure described in the evaluation of the charge stability and the amount of charge was measured by using the instrument shown in FIG. 2.

The amount of triboelectric charge of the sample immediately after shaking in the LL environment was assumed to be Q3 (mC/kg), the amount of triboelectric charge of the sample in the HH environment was assumed to be Q4 (mC/kg), and the charge amount ratio (Q4/Q3) in these environments was used as an indicator of the environmental stability.

The evaluation standard was as follows:

A: Charge amount ratio (Q4/Q3) was 0.90 or more and 1.00 or less

B: Charge amount ratio (Q4/Q3) was 0.80 or more and less than 0.90

C: Charge amount ratio (Q4/Q3) was 0.70 or more and less than 0.80

D: Charge amount ratio (Q4/Q3) was less than 0.70

Durability

The aforementioned printer LBP5300 produced by CANON KABUSHIKI KAISHA was used to evaluate the durability.

In a low-temperature, low humidity environment of 15° C. and 10% RH, an image having a coverage rate of 1% was continuously output. A solid image and a halftone image were output after every 1,000 sheets of printouts and whether longitudinal banding caused by the toner fusion-bonded onto the regulating member, i.e., development banding, occurred was confirmed with naked eye. This operation was repeated and a total of 15,000 sheets of the image were output.

The evaluation standard is as follows:

A: No development banding occurred in 15,000 printouts.

B: Development banding started to occur at a printout in the range from the 13,001-st printout to the 15,000-th printout.

C: Development banding started to occur at a printout in the range from the 11,001-st printout to the 13,000-th printout.

D: Development banding started to occur before the 11,001-st printout.

TABLE 5

| | | Core resin | Shell resin | Shell resin content in toner particles (mass %) | Coverage of toner particle surfaces with shell resin (%) | D4 (μm) | D4/D1 |
|---|---|---|---|---|---|---|---|
| Example 1 | Toner 1 | Block polymer 1 | Resin fine particles 1 for forming shells | 8.0 | 95 | 5.7 | 1.15 |
| Example 2 | Toner 2 | Block polymer 1 | Resin fine particles 2 for forming shells | 8.0 | 95 | 5.8 | 1.18 |
| Example 3 | Toner 3 | Block polymer 1 | Resin fine particles 3 for forming shells | 8.0 | 95 | 5.6 | 1.16 |
| Example 4 | Toner 4 | Block polymer 1 | Resin fine particles 4 for forming shells | 8.0 | 95 | 5.7 | 1.18 |
| Example 5 | Toner 5 | Block polymer 1 | Resin fine particles 5 for forming shells | 8.0 | 95 | 5.6 | 1.14 |

TABLE 5-continued

| | | Core resin | Shell resin | Shell resin content in toner particles (mass %) | Coverage of toner particle surfaces with shell resin (%) | D4 (μm) | D4/D1 |
|---|---|---|---|---|---|---|---|
| Example 6 | Toner 6 | Block polymer 1 | Resin fine particles 6 for forming shells | 8.0 | 95 | 5.9 | 1.19 |
| Example 7 | Toner 7 | Block polymer 1 | Resin fine particles 7 for forming shells | 8.0 | 95 | 5.7 | 1.24 |
| Example 8 | Toner 8 | Block polymer 1 | Resin fine particles 8 for forming shells | 8.0 | 95 | 5.5 | 1.30 |
| Example 9 | Toner 9 | Block polymer 1 | Resin fine particles 9 for forming shells | 8.0 | 95 | 5.8 | 1.16 |
| Example 10 | Toner 10 | Block polymer 1 | Resin fine particles 10 for forming shells | 8.0 | 95 | 5.9 | 1.17 |
| Example 11 | Toner 11 | Block polymer 1 | Resin fine particles 11 for forming shells | 8.0 | 95 | 5.6 | 1.26 |
| Example 12 | Toner 12 | Block polymer 1 | Resin fine particles 12 for forming shells | 8.0 | 95 | 5.7 | 1.32 |
| Example 13 | Toner 13 | Block polymer 1 | Resin fine particles 13 for forming shells | 8.0 | 95 | 6.0 | 1.16 |
| Example 14 | Toner 14 | Block polymer 1 | Resin fine particles 14 for forming shells | 8.0 | 95 | 6.2 | 1.14 |
| Example 15 | Toner 15 | Block polymer 1 | Resin fine particles 15 for forming shells | 8.0 | 95 | 5.6 | 1.16 |
| Example 16 | Toner 16 | Block polymer 1 | Resin fine particles 16 for forming shells | 8.0 | 95 | 5.8 | 1.16 |
| Example 17 | Toner 17 | Block polymer 1 | Resin tine particles 1 for forming shells | 2.0 | 95 | 6.4 | 1.33 |
| Example 18 | Toner 18 | Block pdymer 1 | Resin fine particles 1 for forming shells | 5.0 | 95 | 5.8 | 1.24 |
| Example 19 | Toner 19 | Block polymer 1 | Resin fine particles 1 for forming shells | 12.0 | 95 | 5.7 | 1.19 |
| Example 20 | Toner 20 | Block polymer 1 | Resin fine particles 1 for forming shells | 18.0 | 95 | 5.6 | 1.15 |
| Example 21 | Toner 21 | Block polymer 2 | Resin fine particles 1 for forming shells | 8.0 | 95 | 5.8 | 1.16 |
| Example 22 | Toner 22 | Aliphatic polyester 8 + Amorphous resin 3 | Resin fine particles 1 for forming shells | 8.0 | 95 | 5.8 | 1.16 |
| Comparative Example 1 | Toner 23 | Block polymer 1 | Resin fine particles 17 for forming shells | (8.0)*1 | Undetected | 8.4 | 1.42 |
| Comparative Example 2 | Toner 24 | Block polymer 1 | Resin fine particles 18 for forming shells | 8.0 | 95 | 7.6 | 1.35 |
| Comparative Example 3 | Toner 25 | Block polymer 1 | Resin fine particles 19 for forming shells | (8.0)*1 | Undetected | 7.4 | 1.38 |
| Comparative Example 4 | Toner 26 | Block polymer 1 | Resin fine particles 20 for forming shells | 8.0 | 95 | 5.9 | 1.19 |
| Comparative Example 5 | Toner 27 | Block polymer 1 | Resin fine particles 21 for forming shells | 8.0 | 95 | 6.3 | 1.18 |
| Comparative Example 6 | Toner 28 | Block polymer 1 | Resin fine particles 22 for forming shells | 8.0 | 95 | 6.4 | 1.22 |
| Comparative Example 7 | Toner 29 | Block polymer 1 | Resin fine particles 23 for forming shells | 8.0 | 95 | 5.9 | 1.23 |
| Comparative Example 8 | Toner 30 | Amorphous resin 1 + Amorphous resin 2 | Resin fine particles 18 for forming shells<br>Resin fine particles 19 for forming shells | (5.0 + 5.0)*1 | Undetected | 7.6 | 1.32 |

*1In Comparative Examples 1, 3, and 8, the shell resin content in the toner particles indicates the amount of the shell resin fed.

TABLE 6

| | | Low-temperature fixability Fixing onset temperature | Fixed image stability Rate of decrease in density by rubbing (fixing temperature: 110° C.) | Charge stability (Q2/Q1) | Environmental stability (Q4/Q3) | Durability (occurrence of development banding) |
|---|---|---|---|---|---|---|
| Example 1 | Toner 1 | A (95° C.) | A (1%) | A (0.95) | A (0.94) | A (>15,000) |
| Example 2 | Toner 2 | A (95° C.) | A (1%) | B (0.89) | A (0.94) | A (>15,000) |
| Example 3 | Toner 3 | B (100° C.) | A (1%) | A (0.95) | A (0.93) | A (>15,000) |
| Example 4 | Toner 4 | C (110° C.) | B (3%) | A (0.96) | A (0.92) | A (>15,000) |
| Example 5 | Toner 5 | A (95° C.) | A (1%) | A (0.94) | A (0.93) | B (14,000) |
| Example 6 | Toner 6 | A (95° C.) | A (1%) | A (0.93) | A (0.94) | C (12,000) |
| Example 7 | Toner 7 | B (100° C.) | A (2%) | A (0.94) | A (0.94) | A (>15,000) |
| Example 8 | Toner 8 | C (110° C.) | B (3%) | A (0.94) | A (0.93) | A (>15,000) |
| Example 9 | Toner 9 | A (95° C.) | A (1%) | B (0.84) | B (0.85) | A (>15,000) |
| Example 10 | Toner 10 | A (95° C.) | A (1%) | C (0.74) | B (0.86) | A (>15,000) |
| Example 11 | Toner 11 | A (95° C.) | A (1%) | A (0.95) | B (0.84) | A (>15,000) |
| Example 12 | Toner 12 | A (95° C.) | A (2%) | A (0.95) | C (0.77) | A (>15,000) |
| Example 13 | Toner 13 | A (95° C.) | B (3%) | A (0.96) | A (0.92) | B (14,000) |
| Example 14 | Toner 14 | A (95° C.) | C (8%) | A (0.93) | A (0.93) | C (12,000) |
| Example 15 | Toner 15 | A (95° C.) | A (1%) | C (0.74) | B (0.86) | A (>15,000) |
| Example 16 | Toner 16 | A (95° C.) | A (2%) | C (0.78) | B (0.83) | A (>15,000) |
| Example 17 | Toner 17 | B (105° C.) | A (2%) | A (0.93) | C (0.74) | A (>15,000) |
| Example 18 | Toner 18 | B (100° C.) | A (1%) | A (0.94) | B (0.84) | A (>15,000) |
| Example 19 | Toner 19 | B (105° C.) | B (4%) | A (0.94) | A (0.93) | A (>15,000) |
| Example 20 | Toner 20 | C (110° C.) | C (7%) | A (0.93) | A (0.94) | A (>15,000) |
| Example 21 | Toner 21 | C (115° C.) | C (6%) | A (0.94) | A (0.92) | A (>15,000) |
| Example 22 | Toner 22 | C (115° C.) | C (6%) | B (0.84) | B (0.83) | B (14,000) |
| Comparative Example 1 | Toner 23 | C (110° C.) | B (4%) | D (0.68) | C (0.73) | B (14,000) |

TABLE 6-continued

| | | Low-temperature fixability Fixing onset temperature | Fixed image stability Rate of decrease in density by rubbing (fixing temperature: 110° C.) | Charge stability (Q2/Q1) | Environmental stability (Q4/Q3) | Durability (occurrence of development banding) |
|---|---|---|---|---|---|---|
| Comparative Example 2 | Toner 24 | C (110° C.) | D (15%) | A (0.92) | A (0.92) | D (10,000) |
| Comparative Example 3 | Toner 25 | A (95° C.) | A (1%) | D (0.65) | C (0.72) | A (>15,000) |
| Comparative Example 4 | Toner 26 | B (100° C.) | D (12%) | B (0.85) | A (0.91) | D (8,000) |
| Comparative Example 5 | Toner 27 | C (110° C.) | D (12%) | B (0.83) | A (0.92) | D (7,000) |
| Comparative Example 6 | Toner 28 | A (95° C.) | A (1%) | D (0.62) | C (0.75) | A (>15,000) |
| Comparative Example 7 | Toner 29 | A (95° C.) | A (1%) | D (0.53) | C (0.75) | A (>15,000) |
| Comparative Example 8 | Toner 30 | D (125° C.) | D (15%) | C (0.77) | B (0.83) | D (10,000) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-260887, filed Nov. 29, 2011, which is hereby incorporated by reference herein in its entirety.

REFERENCE SIGNS LIST

1 suction unit (at least the portion in contact with the measurement container 2 was composed of an insulator))
2 metal measurement container
3 screen
4 metal lid
5 vacuum meter
6 air volume controlling valve
7 suction port
8 capacitor
9 potentiometer
T1 granulation tank
T2 resin solution tank
T3 solvent recovery tank
B1 carbon dioxide cylinder
P1, P2 pump
V1, V2 valve
V3 pressure regulating valve

The invention claimed is:

1. A toner comprising toner particles,
wherein:
each of the toner particles has a core-shell structure constituted of a core and a shell phase,
the core contains a binder resin, a colorant, and a wax, and the shell phase contains a resin A, and wherein:
the resin A is a comb polymer having a main chain portion (X), a side chain portion (Y), and a side chain portion (Z),
(i) the main chain portion (X) being a vinyl polymer,
(ii) the side chain portion (Y) having an aliphatic polyester structure, wherein an ester group concentration of a polyester segment is 6.5 mmol/g or less, and
(iii) the side chain portion (Z) having an organic polysiloxane structure in which an average number of Si—O bond repeating units of a siloxane segment is 2 or more and 100 or less.

2. The toner according to claim 1, wherein the side chain portion (Z) includes a segment that has an organic polysiloxane structure represented by formula (1)

[Chem. 1]

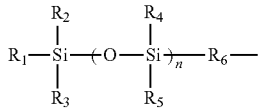

(1)

(where $R_1$ to $R_5$ each independently represent a substituted or unsubstituted alkyl group having 1 or more and 3 or less carbon atoms or a substituted or unsubstituted aryl group, $R_6$ represents an alkylene group having 1 or more and 10 or less carbon atoms, and n represents an integer of 2 or more and 100 or less).

3. The toner according to claim 1, wherein the resin A is a resin obtained by copolymerizing
a vinyl monomer (y) having an aliphatic polyester structure having an ester group concentration in a polyester segment of 6.5 mmol/g or less and
a vinyl monomer (z) having an organic polysiloxane structure represented by formula (2)

[Chem. 2]

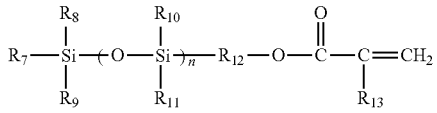

(2)

(where $R_7$ to $R_{11}$ each independently represent a substituted or unsubstituted alkyl group having 1 or more and 3 or less carbon atoms or a substituted or unsubstituted aryl group, $R_{12}$ represents an alkylene group having 1 or more and 10 or less carbon atoms, $R_{13}$ represents a hydrogen atom or a methyl group, and n represents an integer of 2 or more and 100 or less).

4. The toner according to claim 3, wherein the resin A is a resin obtained by copolymerizing
15.0 mass % or more and 50.0 mass % or less of the vinyl monomer (y), 5.0 mass % or more and 25.0 mass % or less of the vinyl monomer (z), and 25.0 mass % or more and 80.0 mass % or less of an additional vinyl monomer where the total amount of the monomers used in the copolymerization is 100 mass %.

5. The toner according to claim 4, wherein the additional vinyl monomer contains a vinyl monomer that contains a carboxyl group and/or a salt thereof.

6. The toner according to claim 4, wherein the additional vinyl monomer contains a vinyl monomer having an aromatic ring.

7. The toner according to claim 1, wherein the toner particles contain 3.0 mass % or more and 15.0 mass % or less of the resin A.

8. The toner according to claim 1, wherein the binder resin contains a crystalline resin as a main component.

9. The toner according to claim 8, wherein the crystalline resin contains a block polymer in which a segment capable of forming a crystalline structure and a segment incapable of forming a crystalline structure are bonded to each other.

10. The toner according to claim 1, wherein the toner particles are obtained by dispersing a resin composition in a dispersive medium to prepare a dispersion, the resin composition being prepared by dispersing or dissolving the binder resin, the colorant, and the wax in an organic solvent, the dispersive medium containing carbon dioxide as a main component and dispersed resin fine particles containing the resin A; and removing the organic solvent from the dispersion.

11. The toner according to claim 1, wherein the ester group concentration in the polyester segment is 5.0 mmol/g or more and 6.5 mmol/g or less.

* * * * *